US007484578B2

(12) United States Patent
Duncan

(10) Patent No.: US 7,484,578 B2
(45) Date of Patent: Feb. 3, 2009

(54) HOLE CORING SYSTEM

(75) Inventor: C. Warren Duncan, Santa Ana, CA (US)

(73) Assignee: U.S. Saws, Inc., Santa Ana, CA (US)

( * ) Notice: Subject to any disclaimer, the term of this patent is extended or adjusted under 35 U.S.C. 154(b) by 77 days.

(21) Appl. No.: 11/646,761

(22) Filed: Dec. 27, 2006

(65) Prior Publication Data

US 2007/0181342 A1 Aug. 9, 2007

Related U.S. Application Data

(60) Provisional application No. 60/759,594, filed on Jan. 17, 2006.

(51) Int. Cl.
*E21B 10/02* (2006.01)

(52) U.S. Cl. ..... 175/402; 175/403; 175/408

(58) Field of Classification Search ..... 175/402, 175/403, 408; 408/204, 67
See application file for complete search history.

(56) References Cited

U.S. PATENT DOCUMENTS

| | | | | |
|---|---|---|---|---|
| 3,094,179 | A * | 6/1963 | Lines | 175/394 |
| 3,810,514 | A * | 5/1974 | Viscovich | 175/403 |
| 5,393,175 | A | 2/1995 | Courville | |
| 5,735,645 | A * | 4/1998 | Dungs | 408/1 R |
| 6,881,016 | B2 * | 4/2005 | May | 408/67 |
| 2004/0191014 | A1 * | 9/2004 | May | 408/67 |

OTHER PUBLICATIONS

Core Drill Rig and Hand-held Core Drill, C.S. Unitec, Inc., 1 page.
Bi-Metal Hole Saw Kits with Pilot Drill, Lenox Co., 2 pages.

* cited by examiner

*Primary Examiner*—Hoang Dang
(74) *Attorney, Agent, or Firm*—Stetina Brunda Garred & Brucker

(57) ABSTRACT

An apparatus for drilling holes in a substrate wherein a mandrel is anchored to the substrate. A hollow drill bit rotates about the mandrel via a drive motor and is a guided along a length of the mandrel.

27 Claims, 18 Drawing Sheets

HOLE CORING SYSTEM

The present application claims the benefit of Provisional Patent Application Ser. No. 60/759,594 filed Jan. 17, 2006.

BACKGROUND OF THE INVENTION

1. Field of the Invention

The present invention relates to a tool designed to drill holes in concrete and other materials.

2. Description of the Prior Art

Holes have been drilled in concrete using masonry drill bits for many years. One problem that has persisted, especially when relatively large-diameter holes are drilled into concrete using a cylindrical, annular core drill bit, is that it is sometimes difficult to maintain the drill bit precisely centered so as to drill a completely circular and aligned large diameter hole into concrete, fiberglass, plastic, and other materials. The problem arises due to the tendency for one edge of the drill to make contact before another edge. Consequently, the drill tries to walk sideways erratically. There is a tendency for the drill bit to wobble or vibrate in a lateral direction, rather than stay precisely centered on the intended drill bit axis. As a result, it is difficult to drill holes in concrete, particularly large diameter holes, with portable equipment.

One prior system that has been developed to attempt to stabilize a drill bit is available under the trade designation "Core Drill Rig". This device operates somewhat in the manner of a drill press. However, unlike a drill press, there can be no stabilizing table beneath a workpiece when drilling into concrete. This is because the concrete structure into which a hole is drilled is always much too thick and expansive to lend itself to stabilization by a table located beneath the drill.

The Core Drill Rig employs a relatively large diameter, annular drill bit mounted on a drill held by a stanchion to one side of a frame. It is necessary to bolt the frame of the Core Drill Rig to the concrete surface to be drilled or hold it in place by suction in order to provide resistance to the drill bit so that the drill bit can penetrate the concrete. If the drill supporting frame is not bolted or otherwise secured to the concrete floor, the drill bit tends to lift off the concrete surface being drilled.

The supporting frame is provided with bolt holes and bolts that must be attached to the concrete structure into which the relatively large diameter hole is to be drilled. First, relatively small diameter holes must be drilled in the concrete at the bolt locations to allow the Core Drill Rig frame to be secured to a concrete floor or wall into which a large diameter hole is to be drilled. Once the frame is bolted to the surface it provides the drill bit with much greater stability than can be achieved using a hand-held drill. However, since the Core Drill Rig must be bolted to the surface, the holes that are used to attach the bolts that secure the frame to the concrete surface must later be filled. Also, considerable effort is required to bolt the frame to the surface to be drilled.

The Core Drill Rig can be configured with a vacuum device that creates a suction to draw the drill frame down to the concrete floor. However, it is difficult to achieve a sufficient suction force to prevent the frame from lifting off the floor and breaking the vacuum if one attempts to operate the drill with high torque. To the contrary, in conventional systems such as the Core Drill Rig, the large diameter drill bit can only be operated at a relatively low speed with a high torque in order for the hole drilled to be circular within acceptable tolerances.

Furthermore, conventional concrete core drills that employ stabilizing frames, such as the Core Drill Rig, are very bulky, heavy, and expensive. They cannot be conveniently packed in a small carry case. They also require a considerable volume of space for transportation in a truck or other work vehicle.

Another conventional annular drilling arrangement is the common hole saw. This is used primarily for cutting holes in wood. The hole saw incorporates a pilot drill fixed in the center of an annular strip of saw blade. The drill bit is simply attached to a chuck driven by a hand drill motor and the pilot drill makes a smaller hole to start off with. As the depth of drilling process progresses the larger annular drill bit engages. At this time the smaller hole acts as a guide for the larger drill.

Although this drilling system has been around for many years it is unsatisfactory for many materials, including concrete. The desirable features of the cutting action for the smaller pilot bit are not the same as those for the cutting action of the larger hole saw. For substances like concrete a percussion action is ideal for drills up to approximately one inch in diameter using carbide tips shaped to pulverize their way through the material with the percussion action. This action is not practical for the larger diameter, thin walled core bit that a hand held drill motor can practically hammer and rotate. Similarly a high rotational speed is more suited to the small pilot drill bit but these speeds may exceed the optimum speed for the large core bit, thus causing overheating and failure of the bit or melting of the material to be cut. In addition, the pilot drill is not aligned in an orientation that can be checked for accuracy before commencing the drilling of the larger hole. Also, the guiding tolerance does not remain constant since the pilot drill tends to "oval" the pilot hole with continued rotation thus causing irregular holes, variable location and misalignment.

SUMMARY OF THE INVENTION

According to the present invention a system has been devised that permits relatively large diameter holes to be drilled in a hard material like concrete, plastic, or fiberglass with a high degree of control in keeping the drill bit centered, but without the disadvantages of prior conventional systems. Specifically, according to the present invention a relatively small diameter pilot hole is first bored into the concrete at the precise center at which a larger diameter hole is to be drilled. Once the pilot hole has been drilled a mandrel is inserted into it and advanced into the hole. The lower end of the mandrel is advanced and then solidly anchored in the pilot hole. The remaining portion of the mandrel extends upwardly and serves as a stabilizing guidepost for a relatively large diameter, hollow drill bit drive shaft.

The large diameter, hollow drill bit has a central, axial opening therein that receives a long, hollow, tubular sleeve of a drive shaft assembly. This sleeve fits over the mandrel and has a lower, hollow coupling which is internally lined with bearings near its lower extremity. A drill motor coupling is provided at the upper end of the tubular sleeve and is equipped with an appropriate fitting for connection to a handheld drill motor. The drill motor, through a suitable chuck arrangement, turns the hollow drive shaft assembly at a high speed in rotation about the anchored mandrel. The drill motor that is coupled to the drive shaft assembly and which turns the drive shaft assembly can be any one of a number of different power sources that are widely utilized in the industry.

The hollow, tubular core drill bit is coupled to the drive shaft assembly and is rotated about the anchored mandrel at a high speed by the hollow drive shaft assembly. The drive shaft assembly is maintained centered, turning in driving rotation in coaxial alignment relative to the mandrel. Internal bearing sleeves at the lower end of the drive shaft assembly reside in longitudinal sliding and rotational sliding contact with the anchored mandrel, thereby ensuring that the drive shaft assembly remains in precise, coaxial alignment with the anchored mandrel. Since the drive shaft assembly carries the tubular core drill bit at its lower end, the tubular core drill bit is likewise held in precise coaxial alignment with the anchored mandrel. As the tubular core drill bit advances into the concrete, the bearing sleeves at the lower end of the drive shaft assembly advance longitudinally along the outer surface of the anchored mandrel, as well as in high speed rotation relative thereto.

By utilizing the superior guidance provided by the mandrel and attached drill, high speed rotation can be achieved without vibration. This high speed enables the same or more power to be developed by the system with the lower pressure that can be applied by a manual operation.

By employing the stabilizing, anchored, mandrel and the hollow drive shaft assembly of the invention, the operator can precisely locate and drill a precision hole in a variety of materials using a hand operated portable tool.

In part because the drill is operated at high speeds, it is highly desirable, if not necessary, to supply cooling water both to cool the tubular core drill bit, as well as the bearings interposed between the drive shaft assembly and the anchored mandrel, and to flush out the concrete debris as it is drilled away. The coupling at the upper end of the drive shaft assembly is preferably equipped with some means to supply water to the cutting teeth of the hollow, tubular core drill bit. In some arrangements water is provided through a water swivel. Because the drive shaft assembly is rotated at a relatively high speed, the cooling water may be supplied down the center of the hollow drive shaft assembly either from a water feed drill motor or by means of a water swivel that conducts a flow of water radially inwardly toward the drive shaft assembly and down through its hollow center. The cooling water flows downwardly in the annular space between the inner surface of the tubular drive shaft assembly and the outer surface of the anchored mandrel and as a film between the bearing sleeves and the anchored mandrel guidepost. Below the bearing sleeves the water flows down into the circular, annular opening being drilled by the tubular core drill bit so as to cool the drill bit teeth and wash away the concrete debris as drilling progresses.

In one broad aspect the present invention may be considered to be an apparatus for drilling holes in concrete comprising: a central, cylindrical mandrel having an upper end, a lower anchoring and a smooth cylindrical intermediate, outer surface therebetween; a hollow, cylindrical annular drive shaft disposed axially about the mandrel and having an upper end with a drive motor coupling and an opposite driven end; at least one bearing mounted to the driven end of the annular, hollow drive shaft and residing in rotational and longitudinal sliding surface contact with the mandrel, whereby the drive shaft is freely rotatable about the mandrel and is also movable longitudinally relative to the mandrel; and a hollow, tubular core bit drill at the lower end of the drive shaft which has a lower annular, serrated edge with cutting teeth thereon.

A further preferred feature of the invention involves a system for releaseably engaging the mandrel with the hollow drive shaft. This feature is particularly advantageous in drilling holes through concrete slab floors in the upper stories of a multistory building. In such a situation the mandrel, together with the cylindrical block or "doughnut" of concrete in which it is embedded will otherwise drop to the story below as the teeth of the annular drill bit break through the final structure of the concrete floor. The falling cylindrical block of concrete with the mandrel embedded therein at the very least will shatter into debris upon which workmen can slip. More importantly, the falling block of concrete could cause serious damage to objects in the space below. When it falls it can also cause serious bodily injury, or even death to a person below.

To prevent such a dangerous situation the mandrel may be provided with a releaseable latching mechanism while the hollow, cylindrical, annular drive shaft is provided with an internal catch located below its driving end. As a result, the latching mechanism engages the internal catch once the driving end of the drive shaft is moved longitudinally relative to the anchoring support end of the mandrel and arrives at a predetermined engagement position relative thereto.

The invention may be described with greater clarity and particularity by reference to the accompanying drawings.

DESCRIPTION OF THE EMBODIMENT

Figure 10:
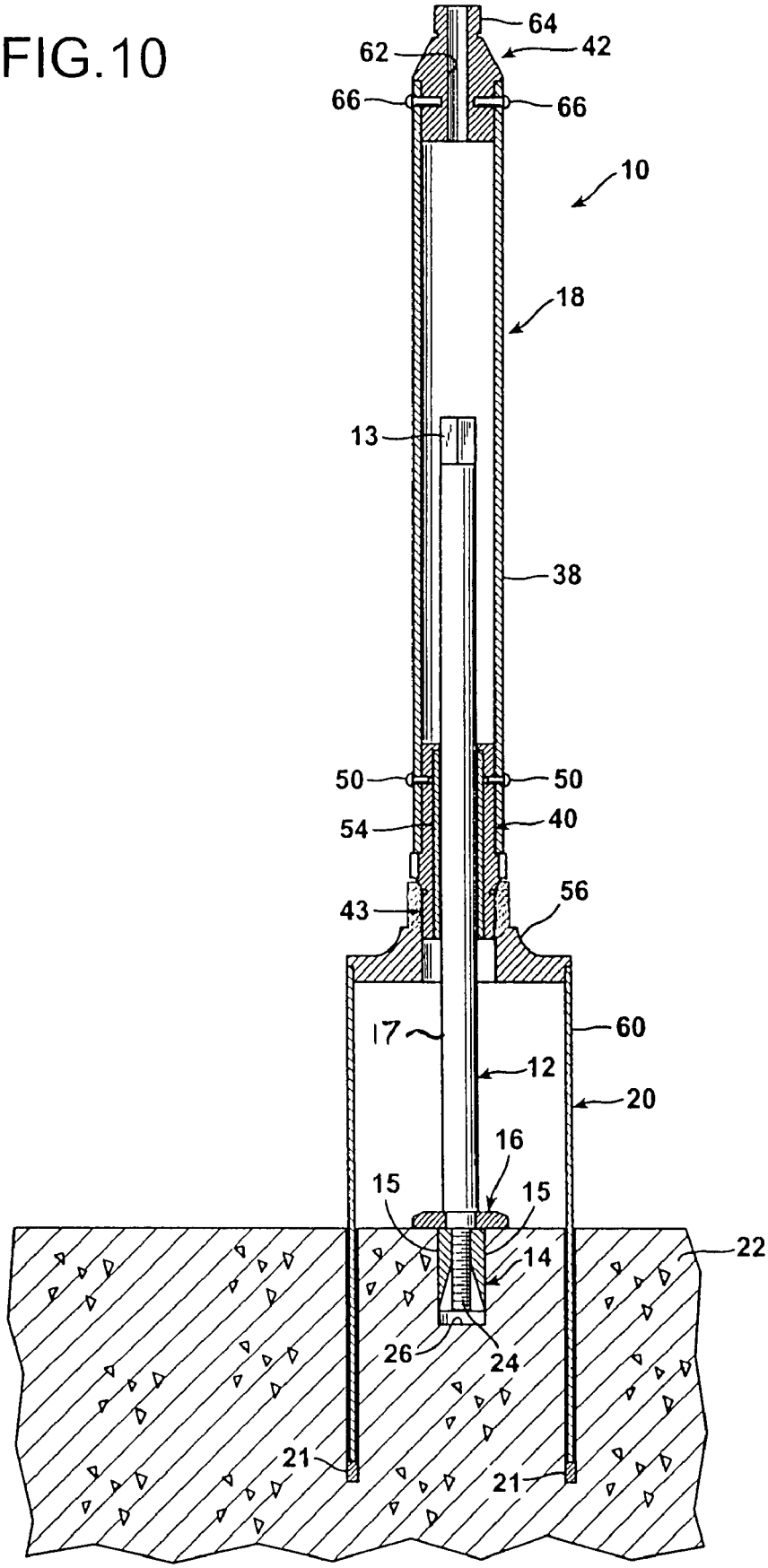
FIG. 10 is a sectional elevational view showing the hole coring system of the invention with components assembled and in operation.

FIG. 10 illustrates a hole coring system 10 according to the invention. The hole coring system 10 includes a mandrel 12, an anchor mechanism 14 attached to the lower end of the mandrel 12, a shoulder washer 16 for stabilizing the mandrel 12, a drive shaft assembly 18, and a hollow, tubular core drill bit 20. The mandrel 12 is a long, solid steel rod having an upper engagement end 13 of hexagonal cross section and an externally threaded lower anchoring support end 24. The mandrel 12 has a smooth, cylindrical, intermediate, outer surface 17 between its upper end 13 and its lower end 24. The diameter of the lower mandrel end 24 is smaller than the diameter of the cylindrical outer surface 17. The mandrel 12 is shown in isolation in FIG. 1.

Figure 4:
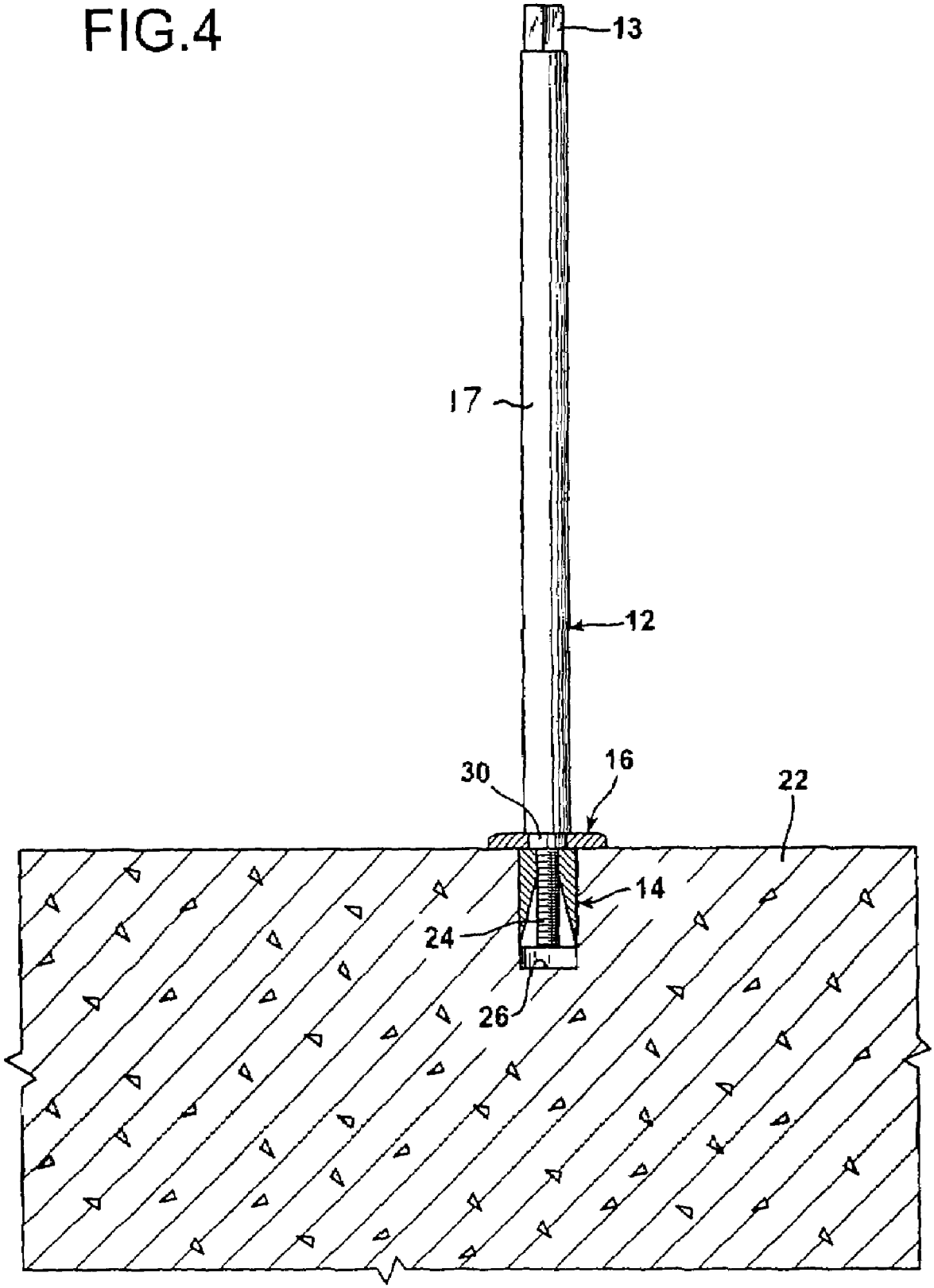
FIG. 4 is an elevational view showing the mandrel anchored in a pilot bore in a slab of concrete.

As shown in FIG. 4 the lower, anchoring support end 24 is provided with an expansion anchor mechanism 14. The anchor mechanism 14 is an expansion anchor that provides a rigid connection between the concrete material to be drilled, indicated at 22, and the mandrel 12. The anchor mechanism 14 in the illustration of FIG. 4 has radially expanding wings 15 and an internally threaded neck that is threadably engaged on the externally threaded lower anchoring support end 24 of the mandrel 12. As the threaded end 24 is advanced into the anchor mechanism 14, the lower ends of the wings 15 of the expansion anchor mechanism 14 are forced radially outwardly, thereby firmly lodging the anchor mechanism 14 in a relatively small diameter pilot bore 26 previously drilled into the concrete 22 using a conventional, small diameter masonry drill.

Figure 1:
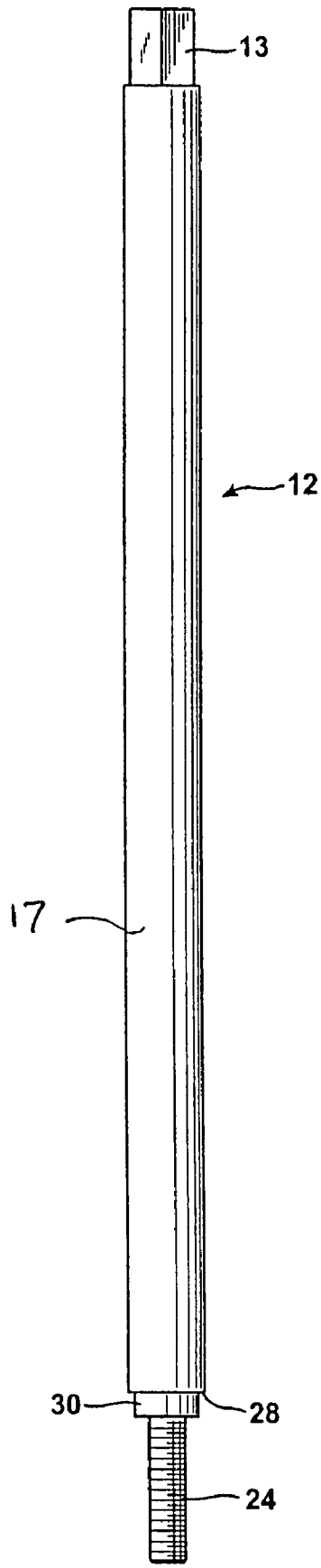
FIG. 1 is a side elevational view illustrating the mandrel of the hole coring system of the invention in isolation.
Figure 2:
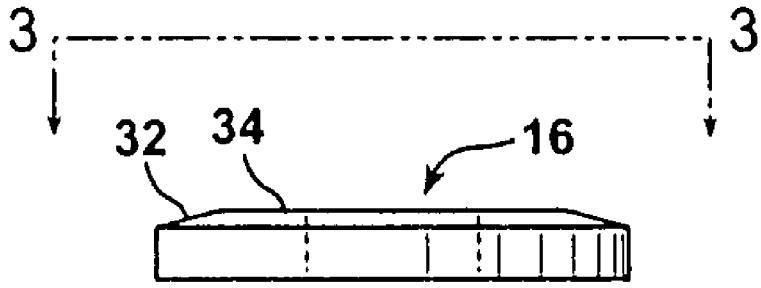
FIG. 2 is a side elevational view of the mandrel stabilizing washer shown in isolation.
Figure 3:
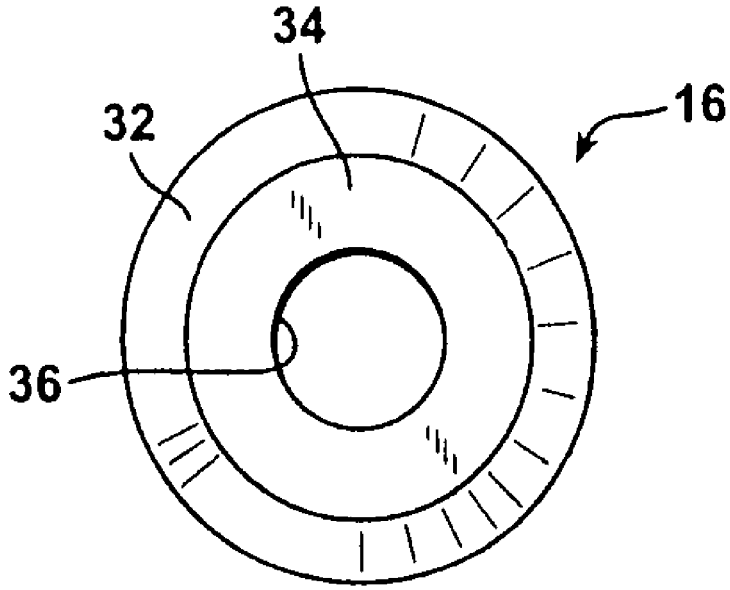
FIG. 3 is a top plan view of the mandrel washer shown in FIG. 2.

Before inserting the lower end 24 of the mandrel 12 into the anchor mechanism 14, the mandrel washer 16 is interposed between the anchor mechanism 14 and the larger, downwardly facing shoulder 28 at the lower end 24 of the mandrel 12. The shoulder 28 is illustrated in FIG. 1. Beneath the shoulder 28 the mandrel 12 is provided with a neck 30 just slightly larger in diameter than the externally threaded tip of the lower mandrel end 24, but smaller in diameter than the smooth, cylindrical, intermediate, outer surface 17. The neck 30 is of an axial length just long enough to receive the shoulder washer 16, shown in isolation in FIGS. 2 and 3.

The shoulder washer 16 is an annular disc-shaped structure which may have a thickness of 0.2 inches and an outer diameter of 1.750 inches and serves as an annular, stabilizing plate. The shoulder washer 16 has a frustoconical surface 32 that tapers slightly from the outer diameter of the shoulder washer 16 up to a flat, annular bearing face 34, which has an outer diameter of 1.250 inches. The diameter of the central aperture 36 of the shoulder washer 16 may, for example, be 0.625 inches.

To install the mandrel 12 in the concrete slab 22, the small diameter, cylindrical pilot bore 26 is first drilled with a masonry drill. The diameter of the bore 26 is of a size corresponding to the outer diameter of the expansion anchor mechanism 14 in its unexpanded state. The anchor mechanism 14 is then inserted into the bore 26 with a force fit against the walls thereof. It may be necessary to pound the anchor mechanism 14 into the position illustrated in FIG. 4. Thereafter, the shoulder washer 16 is inserted onto the lower end of the mandrel 12 oriented perpendicular thereto and disposed about the neck 30. The threaded tip of the lower end 24 of the mandrel 12 is then advanced into the expansion anchor mechanism 14, thereby forcing its expansion wings 15 radially outwardly against the cylindrical wall of the cylindrical pilot bore 26 so that the anchor mechanism 14 is tightly lodged in the bore 26. The mandrel 12 may be advanced downwardly using a wrench to engage the hexagonal upper end 13.

The mandrel and washer are attached to the concrete and the mandrel 12 is tightened against the washer 16, which has a considerably wider base. The mandrel 12 is tightened with sufficient tension so as to form a connection which provides a considerable degree of resistence to bending moment from the proper orientation of the mandrel 12 relative to the concrete slab 22. In this way a stiff and accurate guide is provided for the core drill at some distance from the surface to be drilled.

Figure 7:
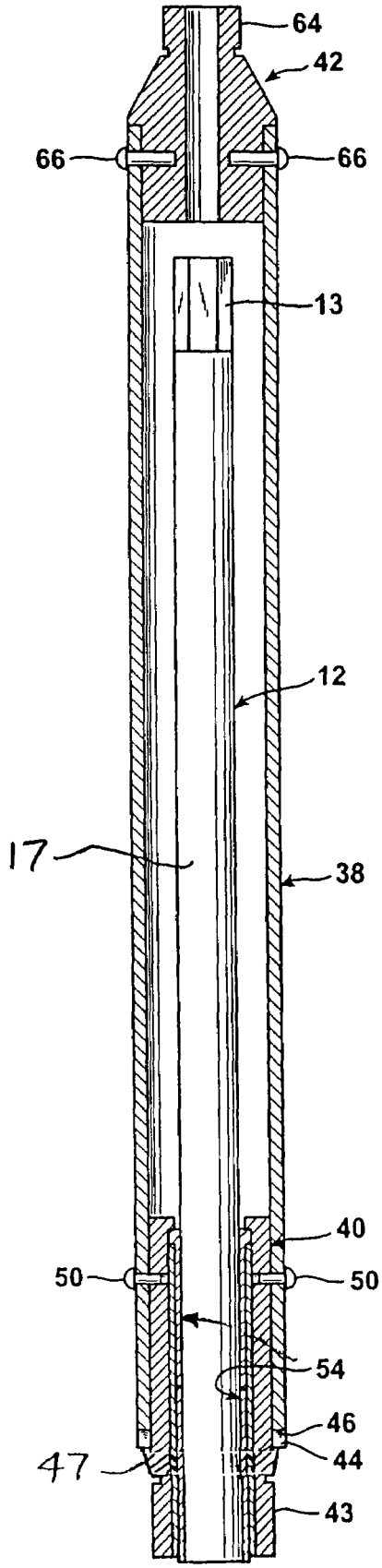
FIG. 7 is a sectional elevational view showing the drive shaft assembly in which the couplings of FIGS. 5 and 6 are engaged on the drive shaft, disposed upon the upper end of the mandrel of FIG. 1.

The lower, externally threaded end 24 of the mandrel 12 is fully advanced into the anchor mechanism 14 until the shoulder 28 bears tightly downwardly to squeeze the mandrel washer 16 against the exposed, flat, horizontal upper surface of the concrete slab 22. The lower extremity of the mandrel 12 is thereby lodged in the anchor mechanism 14, which, in turn, is wedged tightly into the bore 26. The portion of the mandrel 12 above its lower end 24 thereby forms a very firm, upright stabilizing and centering post for the drive shaft assembly 18. The mandrel 12 is oriented perpendicular to the upper surface of the concrete slab 22, as illustrated in FIGS. 4 and 7.

Figure 5:
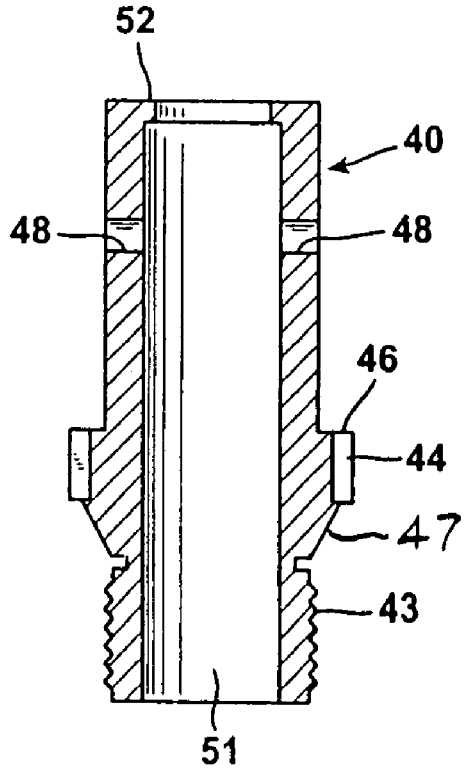
FIG. 5 is a sectional elevational detail showing the lower coupling for the lower end of the drive shaft in isolation.
Figure 9:
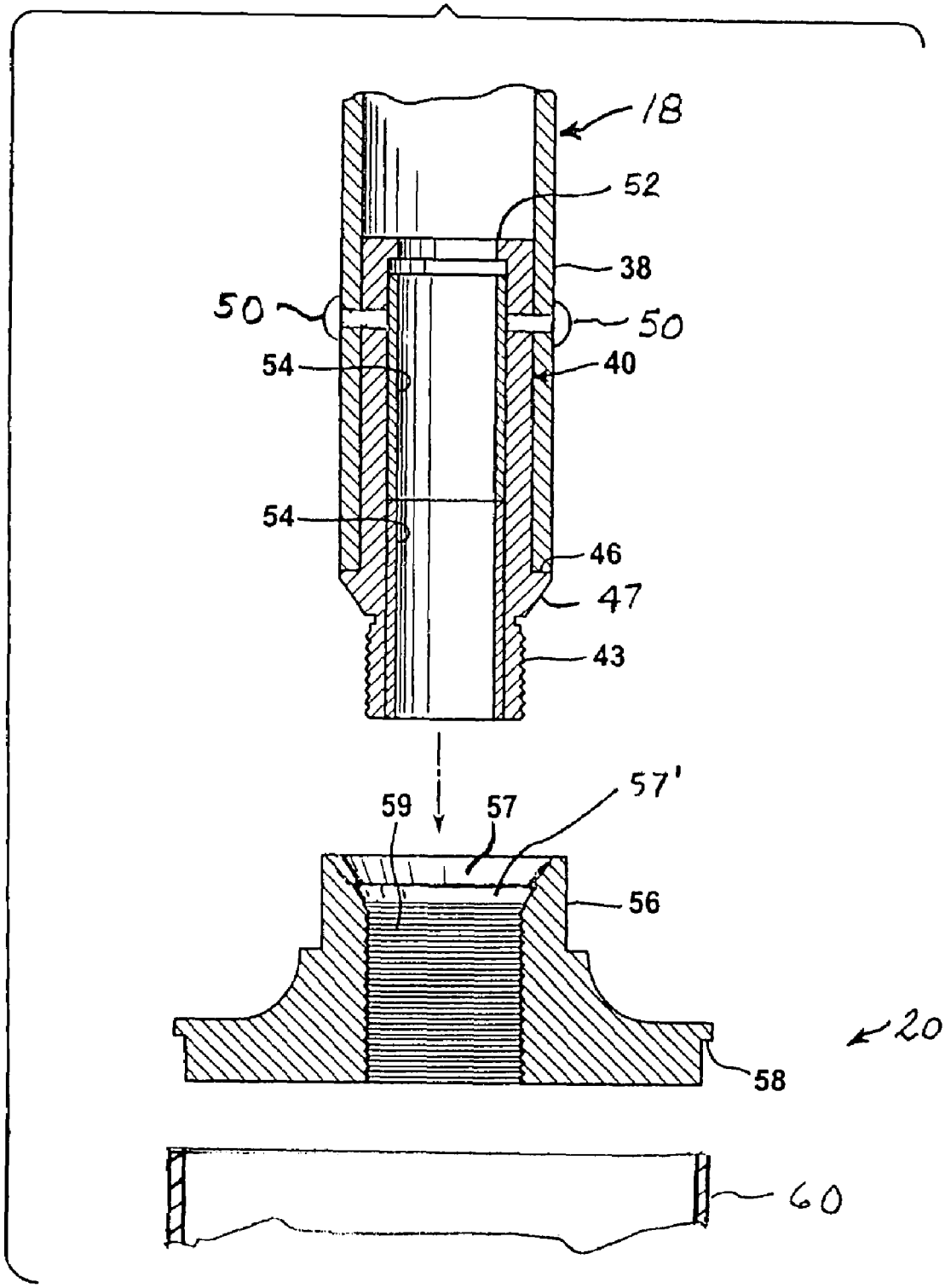
FIG. 9 is an exploded sectional detail illustrating the threaded connection and bearing sleeves at the lower end of the drive shaft assembly in preparation for engagement with the tubular core drill bit collar.

The drive shaft assembly 18 is formed of a hollow, tubular, cylindrical annular drive shaft 38 having an externally threaded, hollow lower drill bit coupling 40 inserted into its lower extremity and an externally threaded drive motor coupling 42 inserted into its upper extremity. The lower coupling 40 is illustrated in section and in isolation in FIG. 5. The lower coupling 40 is provided with a barrel-shaped body with an externally threaded nipple 43 at its lower end. The nipple 43 may be provided with a 1¼-12 Class 3B thread. Above the nipple 43 the lower coupling 14 is provided with a radially outwardly tapered region 47 that terminates in a drive shaft seat 44 that defines an upwardly facing annular shoulder 46. The shoulder 46 is of a diameter slightly greater than the outer diameter of the tubular drive shaft 38 so as to seat the lower edge of the drive shaft 38 which resides in abutment thereon, as shown in FIGS. 7 and 9. The lower coupling 40 is provided with a pair of diametrically opposed, internally threaded, radially directed fastener bores 48, as illustrated in FIG. 5. The fastener bores 48 receive the externally threaded shanks of a pair of diametrically opposed shear pins 50, as illustrated in FIG. 10.

The interior of the lower coupling 40 has a smooth cylindrical wall 51 throughout most of its length but terminates at a reduced diameter collar 52 at its upper extremity. The smooth wall bore 51 through the lower coupling 40 accommodates at least one, and preferably a pair of cylindrical, annular Oil Lite bearing 54. These are annular bronze sleeve-shaped bearings 54 formed of porous powdered metal and vacuum impregnated with oil that lasts the useful life of the bearings 54. The pair of bearings 54 are visible in FIGS. 7 and 10 and are illustrated in greater detail in the exploded view of FIG. 9. The internal diameter of the bearings 54 just fits over the outer diameter of the cylindrical intermediate outer surface 17 of the upwardly projecting shaft portion of the mandrel 12.

The nipple 43 of the lower coupling 40 is threadably engageable in the internally tapped collar 56 attached to the tubular core drill bit 20, as indicated in FIG. 9. The collar 56 is internally chamfered and has a elevated, frustoconical band 57 at its upper extremity. The band 57 is elevated a distance of 0.010 inches above the chamfered region 57' located beneath and radially inwardly from the band 57. That is, the outer annular band 57 is raised a small distance up from the inner chamfered surface 57'. The reason for providing the frustoconical band 57 on the internal engagement surface of the collar 56 is to provide a stabilizing bearing surface that resists torsional forces acting in a vertical plane that passes through the axis of alignment of the drive shaft assembly 18.

The collar 56 is internally threaded at 59, as shown in FIG. 9. Due to the necessary tolerances that are required between the threaded nipple 43 and the internal threads 59 in the collar 56, bending forces exist that would otherwise tend to bend the drive shaft assembly 18 out of precise coaxial alignment with the collar 56. However, by providing the elevated frustoconical band 57 radially outboard as far as possible from the axis of alignment of the drive shaft assembly 18 and the collar 56, the complete, tightened engagement of the threads of the nipple 43 with the internal threads 59 provides centering and alignment forces at the interface between the two matched, inclined surfaces 57 and 47. The result is that the drive shaft assembly 18 is clamped tightly to the core drill bit 20 so that the drive shaft assembly 18 and the core drill bit 20 are held in tight, nearly perfect alignment. These forces correct the "play" that would otherwise occur between the male threads of the nipple 43 and the female threads 59 of these two key components, namely the lower coupling 40 and the collar 56.

Figure 8:
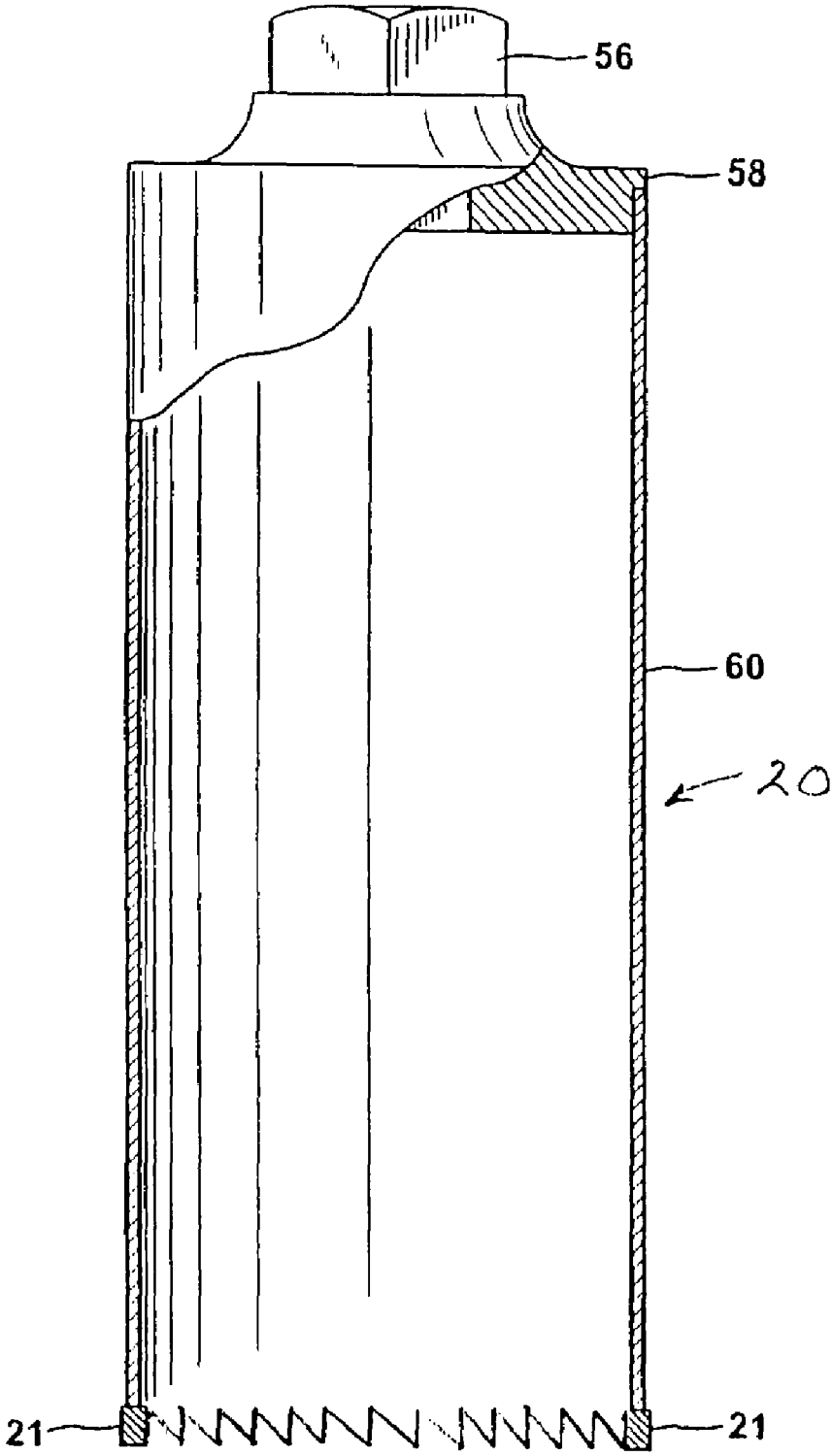
FIG. 8 is an elevational view, partially broken away in section, of the tubular core drill bit shown in isolation.

The collar 56 includes a radial, annular flange 58 that provides a seat for the upper edge of the relatively large diameter, cylindrical, annular portion 60 of the tubular core drill bit 20, as illustrated in FIG. 8. The core drill bit 20 has an opposite, annular lower edge 21 that is serrated and has a multiplicity of industrial diamond concrete cutting teeth thereon.

Figure 6:
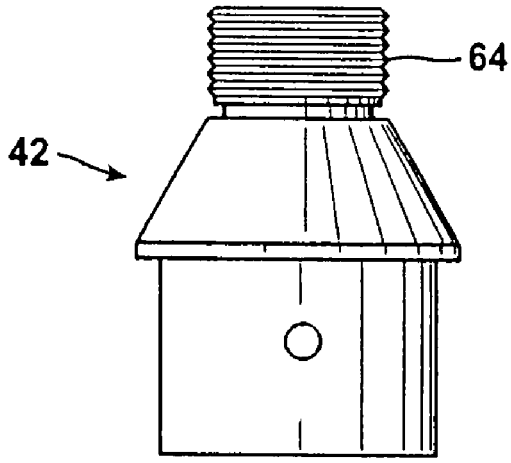
FIG. 6 is an elevational detail showing one embodiment of an upper coupling for the upper end of the drive shaft, shown in isolation.

At its upper end extremity the drive shaft assembly 18 is provided with an upper coupling member, which may be the drill bit coupling 42 illustrated in FIGS. 6 and 10. The coupling member 42 has a hollow, cylindrical duct 62 defined axially down its center, as shown in FIGS. 7 and 10. The duct 62 is provided to receive water from a conventional water feed drill motor equipped with its own cooling water supply (not shown). The upper, hollow extremity of the upper drill bit coupling 42 terminates in an externally threaded male tip 64 that is engaged in a female socket in the conventional water-feed drill motor. The upper coupling 42 is rigidly attached to the upper extremity of the tubular drive shaft 38 by means of a pair of diametrically opposed shear pins 66 that have shanks that extend into radial bores defined in the wall structure of the upper coupling 42, as illustrated in FIGS. 7 and 10.

Once the mandrel 12 has been installed in the concrete 22 so that its upper extremity extends upwardly in the manner of an upright guidepost, as illustrated in FIG. 4, the male connector 64 of the upper coupling 42 is threaded into the internally threaded female socket in the water-cooled drill motor, while the nipple 43 at the lower coupling 40 is threaded into the collar 56 of the tubular core drill bit to which it is rigidly connected, as indicated in FIG. 9. The hole coring assembly 10 is then lowered down onto the mandrel 12, with the bearings 54 residing in contact with the outer surface 17 of the mandrel 12 to ensure precise, coaxial alignment of the drive shaft 38 of the drive shaft assembly 18 relative to the mandrel 12, as shown in FIG. 10.

Once the teeth at the lower edge 21 of the tubular core drill bit 20 reach the upper surface of the concrete slab 22, the drill motor is operated, thereby rotating the entire drive shaft assembly 18 in rotation about the stationary mandrel 12. The permanently lubricated bearing sleeves 54 allow high speed rotation-of the drive shaft assembly 18 relative to the mandrel 12. For example, where the outer diameter of the tubular core drill bit 20 is four inches, the drive shaft assembly 18 can be rotated at a speed of 6000 RPM. In contrast, the same drill bit of a conventional Core Drill Rig can only be rotated at a maximum speed of about 600 RPM. The ability to rotate the core drill bit 20 of the present invention at high speed allows the operator to manage the same horsepower with less torque reaction. As a result the force applied to the cutting surfaces is lower and the cutting speed of the diamond teeth used is closer to optimum cutting speed. This allows the system to cut as fast as a drill rig of similar power.

Furthermore, in the hole coring system of the invention the bearings 54 are located much closer to the upper surface concrete material 22 than the bearings of a conventional tubular core drill bit assembly. By stabilizing the drive shaft 38 closer to the surface of the concrete slab 22, greater stability and precise centering of the tubular core bit assembly 20 relative to the stationary mandrel 12 is achieved. The relatively long overall lengths of about three inches of the tandem mounted bearings 54 within the lower coupling 40 aid in stabilizing the drive shaft assembly 18, so that it remains perpendicular to the concrete slab 22.

The hole coring system 10 of the invention may be utilized to drill holes having a diameter of between three inches and eight inches. Preferably, the pilot bore 26 has a diameter of about one-half inch.

Once the drive shaft assembly 18 with the tubular core drill bit assembly 20 attached thereto has been lowered onto the mandrel 12 and centered relative thereto by the bearings 54, the cooling and flushing water is turned on, and the motor is actuated to turn the drive shaft assembly 18. Rotation of the core bit assembly 20 starts when the lower edge of the core drill bit 20 is just above the surface of the concrete 22 to be cut. The core drill bit 20 is then pushed gently downwardly with a force sufficient to overcome the water pressure of the cooling water that is entrapped between the mandrel 12 and the core drill bit 20.

The mandrel 12 is an accurately sized piece of high strength steel. The mandrel 12 forms a guide and axle about which the cylindrical, annular, saw blade 60 spins at high speed. The drive shaft assembly 18 serves the dual function of connecting the motor power for turning the core drill bit 20, and also guiding the core drill bit 20 by means of the internal bearing sleeves 54 that run on the mandrel 12. Depending upon the depth of the large diameter hole to be cut, it may be necessary to withdraw the core drill bit 20, break off the concrete core that has been cut, then drill further using the hole that has been cut that far as a guide for further drilling.

During the drilling process, cooling and flushing water flows from the water supply within the drill motor down through the central duct 62, down through the hollow drive shaft 38, and into the annular space between the inner surface of the drive shaft 38 and the outer surface 17 of the mandrel 12. The cooling water flows through the neck at the upper end of the lower coupling 40 and past the bearings 54 which provide sufficient clearance for the passage of liquid. The cooling water flows downwardly into the cylindrical, annular cavity between the mandrel 12 and the inner wall surface of the core bit 20, and down into the cylindrical, annular groove or channel cut by the industrial diamond teeth at the lower edge 21 of the core bit assembly 20 into the concrete 22. Water is flushed downwardly below the lower cutting teeth of the core bit 20 and back upwardly alongside the outer surface of the core bit 20 to flush powdered concrete granular material radially outwardly away from the hole coring system 10 and across the flat upper surface of the concrete slab 22.

Figure 11:
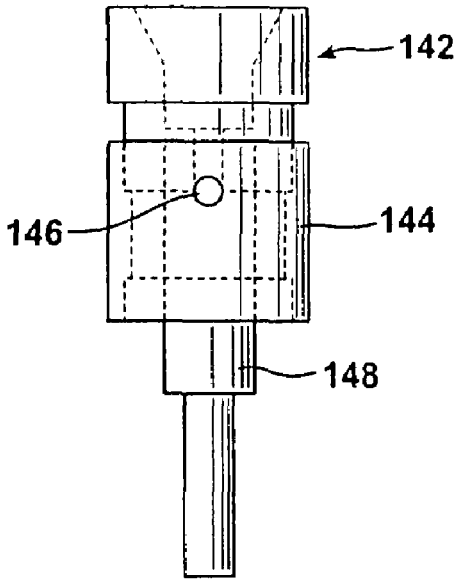
FIG. 11 is an elevational detail illustrating a different upper drive shaft end threaded connection according to the invention employing a water swivel.

It is to be understood that numerous variations and modifications of the components of the hole coring system are possible. For example, the particular adapter or lower drill bit coupling 42 is designed for use with an electric drill motor having its own water supply. FIG. 11 illustrates an alternative embodiment of the invention in which the upper coupling 142 is an adapter for a drill chuck without a water supply. The coupling 142 is provided with a water swivel 144 having a radial port 146 through which water is directed radially inwardly and then down alongside the shank 148 of the adapter 142.

Figure 12:
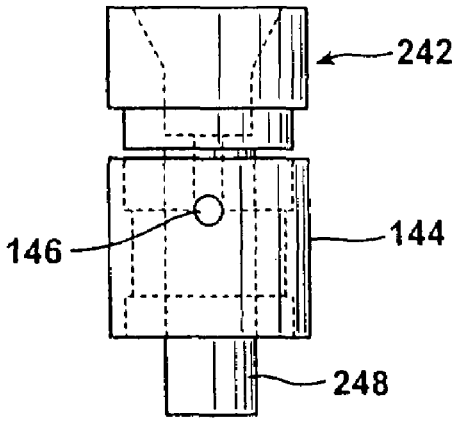
FIG. 12 is an alternative embodiment of the connection illustrated in FIG. 11.

FIG. 12 illustrates still another embodiment in which an electric grinder adapter 242 is also provided with a water swivel 144 having radial water input apertures 146. The adapter 242 differs from the adapter 142 in that the adapter 142 includes a stepped shank having an upper, larger diameter portion and also a narrower, lower small diameter portion. In the embodiment of FIG. 12 the shank 248 of the adapter 242 has a uniform diameter throughout.

Once the core has been cut, the mandrel 12 can be used as a handle to remove the concrete core from the concrete slab 22. The freshly cut concrete core can be dislodged from the mandrel 12 so that the mandrel can be reused.

Different mandrels are available and may be utilized. For example, a self-drilling mandrel may be utilized if the material to be drilled is plastic, rather than concrete. Also, mandrel anchors may be provided as either disposable items or reusable structures. Reusable anchors are preferably provided for the larger diameter anchor holes.

The drill motor that drives the drive shaft can be any one of a multitude of power drill motors that are available in the construction industry. Also, while water is preferably supplied in the drilling process as the preferred cutting fluid, other liquids such as oil or some other fluid may be utilized instead.

As previously explained, a very advantageous feature of preferred embodiment of the invention involves the releaseable latching of the hollow drive shaft to the mandrel. FIGS. 13-16 and illustrate one such embodiment employing a hollow mandrel 120 which may be releaseably engaged by the hollow drive shaft 180. The hollow mandrel 120 is illustrated in isolation in FIG. 13 and defines a mandrel cavity 122 of circular cross-section therewithin. The mandrel 120 has an upper engagement end 123 and a lower anchoring end 124 while an upper internal bearing ledge 127 (FIG. 16) is located a short distance below the upper engagement end 123. A lower internal bearing ledge 126 is located above the anchoring support end 124. The lower internal bearing ledge 126 serves as a delineation in the mandrel cavity 122 between an intermediate cylindrical cavity portion 128 and a lower cylindrical cavity portion 130. The upper bearing ledge 127 delineates the intermediate cylindrical cavity portion 128 from an upper cylindrical cavity portion 129. The intermediate cylindrical cavity portion 128 is greater in diameter than the lower cylindrical cavity portion 130, while the upper cylindrical cavity portion 131 is slightly greater in diameter than the intermediate cylindrical cavity portion 128.

A longitudinally extending, elongated slot 132 is defined diametrically through the mandrel 120 and extends radially between the smooth, cylindrical intermediate outer surface 17 thereof and the lower cylindrical cavity portion 130 therewithin. The elongated slot 132 is located beneath the bearing ledge 126.

Diametrically opposed, circular, radial latching lug openings 134 are defined a short distance beneath the upper engagement end 123 in the hollow mandrel 120. The latching lug openings 134 extend between the smooth, cylindrical, intermediate, outer surface 17 of the hollow mandrel 120 and the upper, cylindrical cavity portion 128 therewithin.

A piston 150 is provided which has a circular cross-section and a shoulder 152 which divides the piston 150 into a cylindrical, enlarged diameter upper portion 154 and a cylindrical, reduced diameter lower portion 156. The piston 150 is mounted for reciprocal movement within the mandrel cavity 122.

A transverse latch release lever 158 passes diametrically through the reduced diameter lower portion 156 of the piston 150 and through the slot 132 to project radially outwardly behind the cylindrical outer surface 17. The latch release lever 158 provides a means for manually moving the piston 150 in reciprocal nature within the cavity 122 in the hollow mandrel 120. The bearing ledge 126 limits the downward movement of the shoulder 152 of the piston 150 within the hollow mandrel 120, while the upward movement of the piston 150 is limited when the latch release lever 158 reaches the top of the elongated slot 132.

Figure 14:
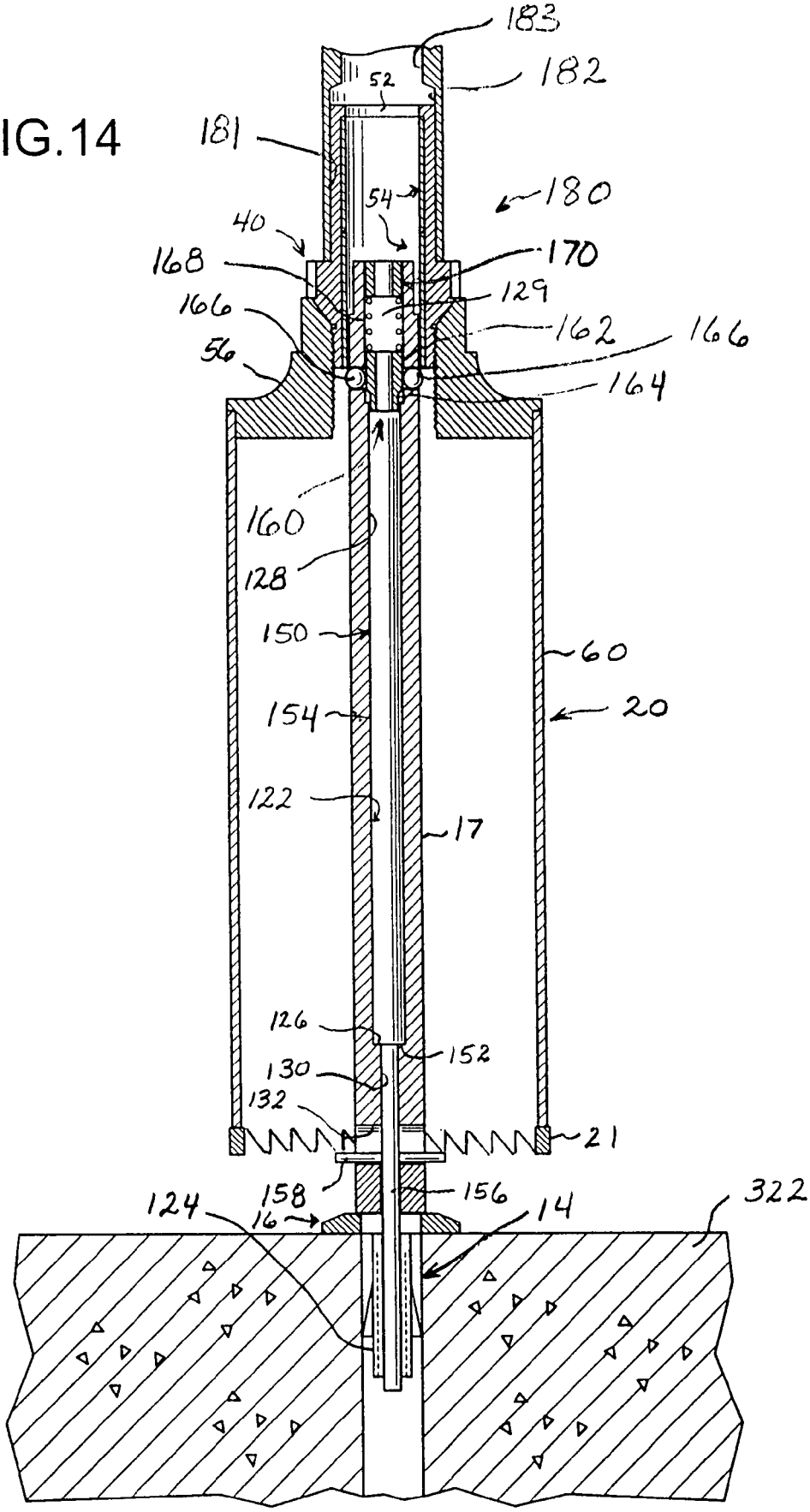
FIG. 14 is a sectional elevational view showing the hollow drive shaft assembly with a core drill bit engaged thereon being lowered onto the mandrel of FIG. 13.
Figure 15:
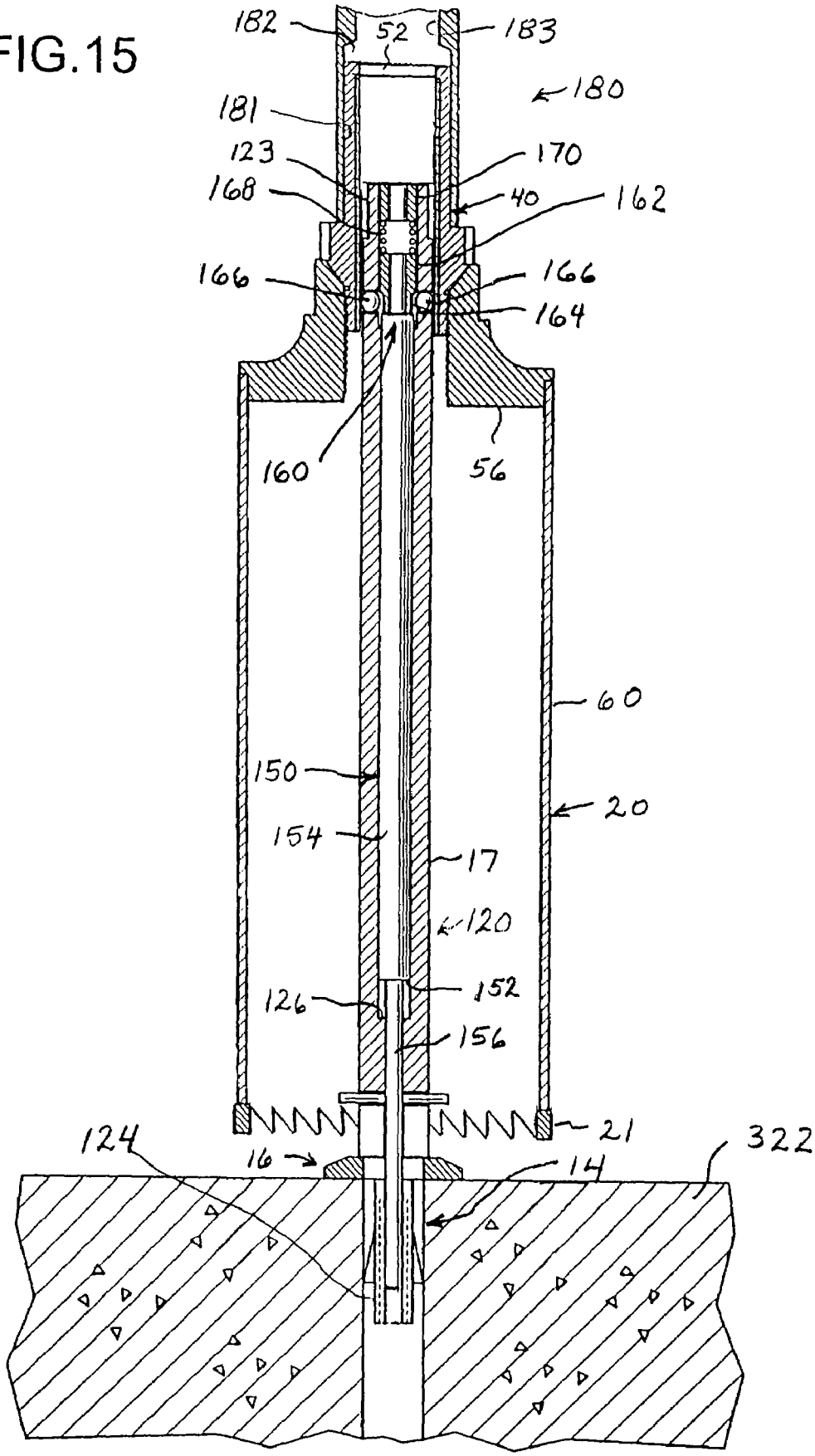
FIG. 15 illustrates retraction of the latching mechanism of the mandrel in the embodiment of FIG. 14.
Figure 16:
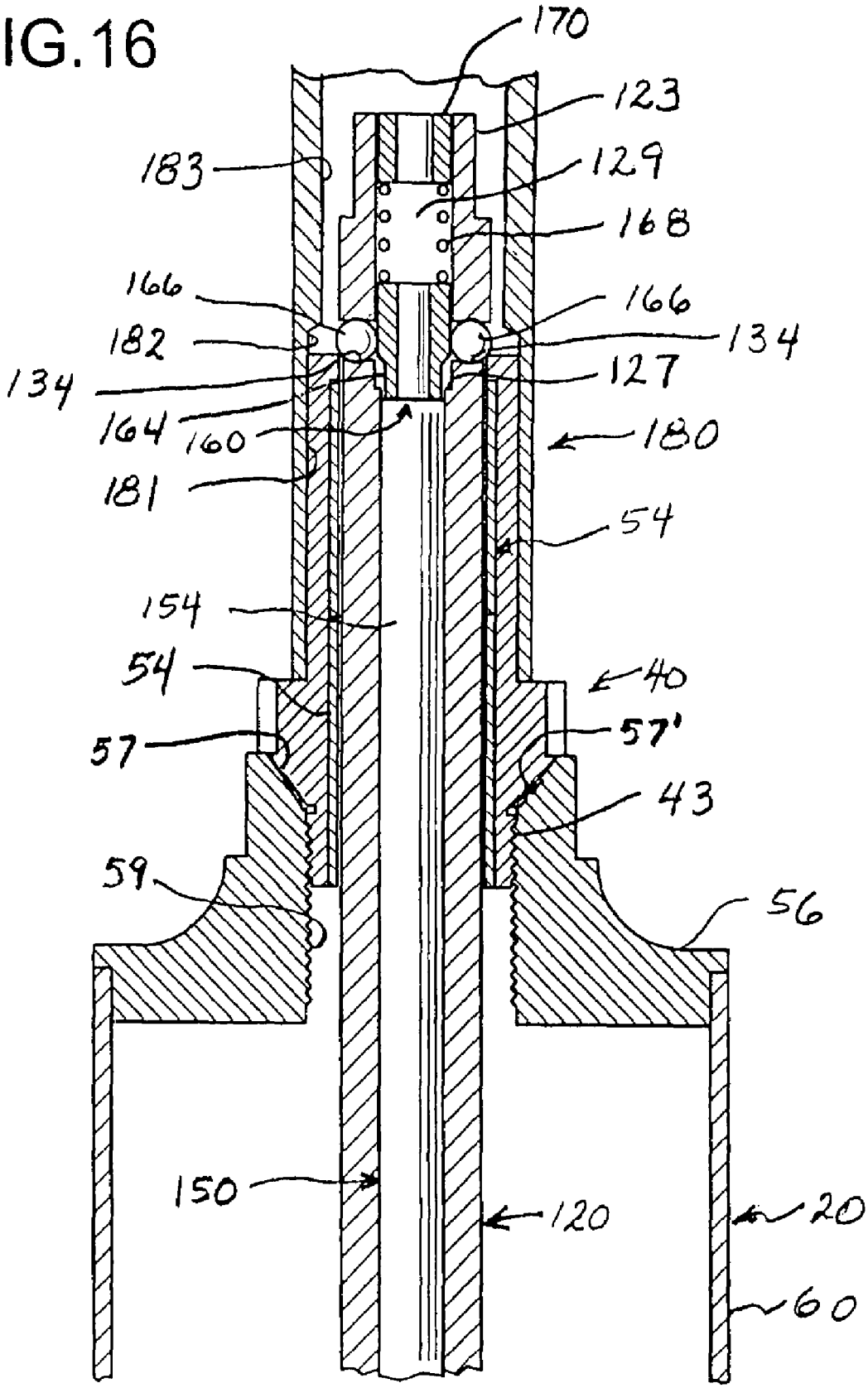
FIG. 16 illustrates engagement. between the latching and catch mechanisms of the embodiment of FIG. 14.

A piston head 160 is located atop the piston 150 and is illustrated in greater detail in FIGS. 14-16. The piston head 160 has a cylindrical, annular upper portion 162 that slides smoothly within the smooth wall of the upper cylindrical cavity portion 129 of the mandrel cavity 122. At its lower extremity the piston head 160 is necked down to form as part of its structure a lower, reduced diameter latching lug receiving neck 164.

Figure 13:
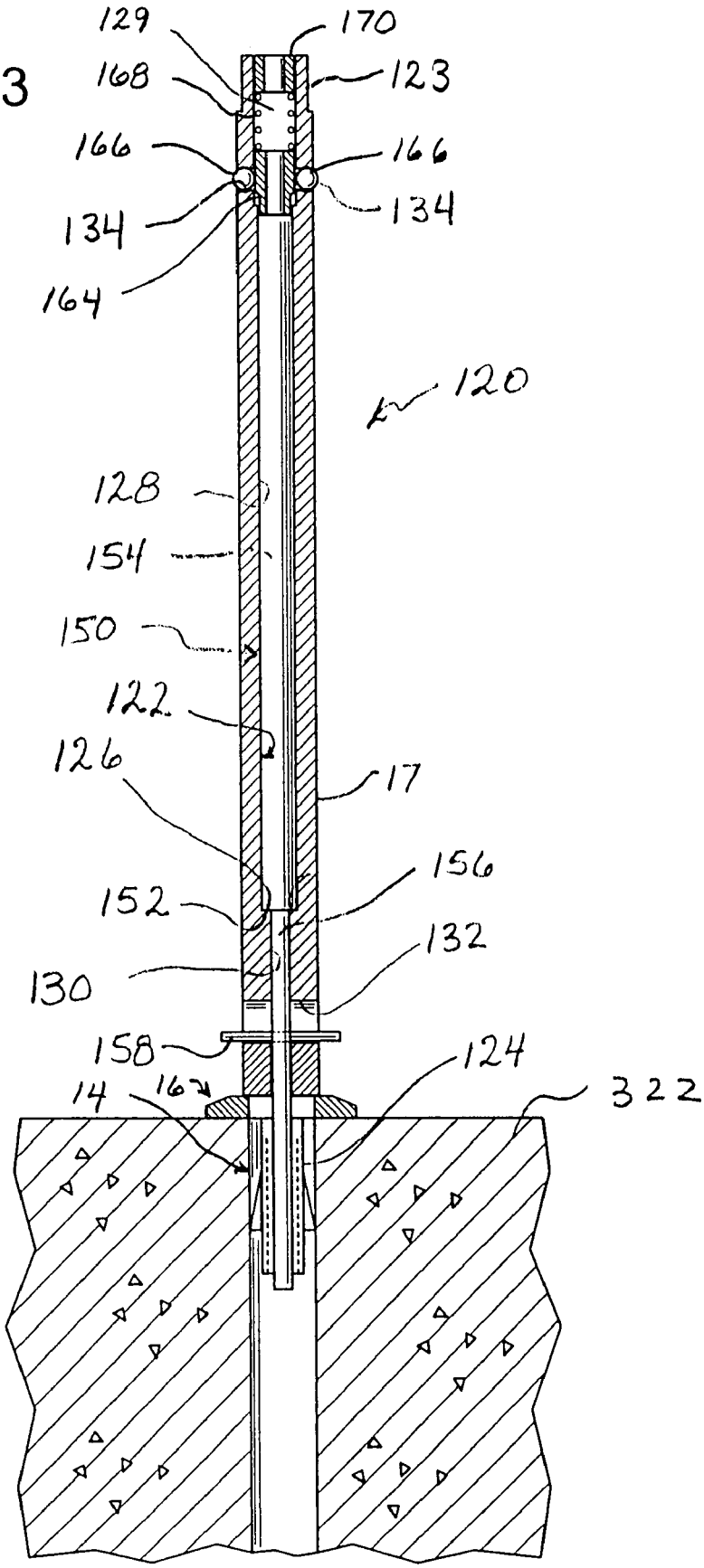
FIG. 13 illustrates another alternative embodiment of a mandrel employed according to the system of the invention.

A pair of diametrically opposed latching lugs in the form of a pair of small spheres 166 are located in the mandrel 120 within the diametrically opposed radial latching lug openings 134 therein. The mouth apertures of the transverse, radial latching lug receiving openings 134 at the outer surface 17 of the mandrel 120 are very slightly smaller in diameter than the transverse, radial openings 134 and the spherical lugs 166 therein. Consequently, while the radial outermost surfaces of the spherical latching lugs 166 can protrude radially outwardly behind the outer diameter of the smooth, cylindrical outer surface 17, as illustrated in FIG. 13, the spherical lugs 66 remain entrapped by the structure of the mandrel 120.

A coil spring 168 is located within the upper cavity portion 129 of the hollow, cylindrical cavity 122 within the mandrel 120 atop the piston head 160. The coil spring 168 is compressed against the top of the piston head 160 by an annular plug 170. The coil spring 168 thereby biases the piston head 160 and the piston 150 in a downward direction toward the anchoring support end 124 of the mandrel 120. This biasing action normally pushes the latching lug receiving neck 164 out of radial alignment with the spherical latching lugs 166. As a consequence, under the normal actions of the biasing spring 168, the upper portion 162 of the piston head 160 pushes the latching lugs 166 radially outwardly so that their outer surfaces protrude slightly radially beyond the outer surface 17 of the mandrel 120, as illustrated in FIG. 13.

The hollow, cylindrical annular drive shaft 180 differs in construction from the drive shaft 18. Specifically, the interior diameter of the interior wall surface 183 of the intermediate portion of the drive shaft 180 above the lower coupling 40 is smaller than the interior diameter of its lower end. The lower end of the drive shaft 180 thereby forms an internal socket 181 that receives the lower coupling 40 therewithin. However, the diameter of the interior wall surface 183 is slightly greater than the interior diameter of the bearing 54 so that it provides clearance for the outer surface of the spherical lugs 166, as illustrated in FIG. 16. Also, an internal, radial annular channel 182 of even greater diameter is defined just above the socket 181 that receives the lower coupling 40. The channel 182 is located within the drive shaft 180 and below the wall surface 183 of the interior intermediate portion of the drive shaft 180 between the driving end thereof (not visible) and the bearings 54.

In operation the drive shaft 180 is disposed coaxially about the mandrel 120 and lowered in coaxial alignment therewith, as illustrated in FIG. 14. However, due to the force of the biasing spring 168, the piston head 160 and the piston 150 are pushed downwardly so that the shoulder 152 of the piston 150 resides in abutment against the internal bearing ledge 126 within the mandrel 120. When the piston head 160 is forced downwardly in this manner, the latching lug receiving neck 164 is located within the mandrel 120 at a level lower than the latching lugs 166, so that downward movement of the hollow drive shaft 180 is limited by the interference between the lowermost cylindrical bearing 54 and the radially outwardly protruding portions of the latching lugs 166.

When the hollow drive shaft 180 is lowered to the position depicted in FIG. 14, the user lifts upwardly on the latch release lever 158, thereby overpowering the spring 168 and pushing the piston 150 upwardly within the mandrel cavity 122, as illustrated in FIG. 15. When the latch release lever 158 resides in abutment against the upper edge of the longitudinally elongated slot 132, the latching lug receiving neck 164 of the piston head 160 resides in longitudinal registration and in radial alignment with the spherical latching lugs 166. This allows the spherical latching lugs 166 to be pushed radially inwardly by the weight of the drive shaft 180 and the annular core drill bit 20, which can then be lowered downwardly toward the surface of the concrete 22, as indicated in FIG. 15.

The drill motor is then coupled to the upper end of the drive shaft 180 and operated, thereby driving the drive shaft 180 in rotation about the hollow mandrel 120. As the annular core drill bit 20 progresses downwardly the lower coupling 40 and the lower end of the drive shaft 180 also move downwardly, as illustrated in FIG. 15. Once the lower coupling 40 advances downwardly past radial alignment with the piston head 160, its upper edge clears the spherical latching lugs 166, as illustrated in FIG. 16. Without radial resistance against the spherical latching lugs 166 applied by the bearings 54 within the lower coupling 40, the force of the spring 168 is sufficient to push the piston head 160 and the piston 150 back downwardly thereby forcing the upper portion 162 of the piston head 160 into longitudinal registration with the spherical latching lugs 166. This movement forces the spherical latching lugs 166 radially outwardly and into the gap that exists at the radial, annular channel 182 defined near the lower end of the hollow, cylindrical annular drive shaft 180 just above the lower coupling 40.

Clearance also exists between the radially extended latching lugs 166 and the drive shaft interior wall surface 183 as the drill bit 20 descends further into the concrete slab 322. When this occurs the spherical latching lugs 166, which form the engageable part of the latch mechanism of this embodiment, have sufficient clearance with respect to the interior wall surface 183 to allow continued downward movement of the drive shaft 180 about the hollow mandrel 120. This downward movement continues until the annular drill bit 20 cuts completely through the slab of the concrete 322.

At this point the mandrel 120, together with the "doughnut" of concrete in which is embedded tend to drop downwardly relative to the drive shaft 180. However, once the mandrel 120 drops sufficiently so that the spherical latching lugs 166 meet the upper edge of the lower coupling 40, further downward movement is arrested. This is because the upper portion 162 of the piston head 160 has a large enough diameter so that the spherical latching lugs 166 cannot be pushed radially inwardly within the openings 134 a sufficient distance to clear the internal diameter of the upper end of the lower coupling 40. As a consequence, the spherical latching lugs 166 are lodged in the internal, radial, annular channel 182 in the hollow drive shaft 180, so that they releaseably couple the mandrel 120 to the hollow drive shaft 180. The mandrel 120 remains engaged with the hollow drive shaft 180 until the latch release lever 158 is again purposely forced upwardly in the slot 132 to overcome the biasing spring 168 and bring the piston head neck 164 into longitudinal registration with the spherical latching lugs 166. This allows the mandrel 120 to be withdrawn from the drive shaft 180.

Figure 18:
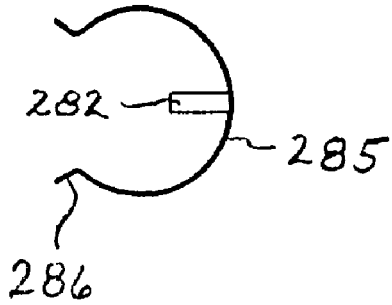
FIG. 18 is a top plan detail of the biasing spring and catch pin employed in the embodiment of FIG. 17, shown in isolation.
Figure 17:
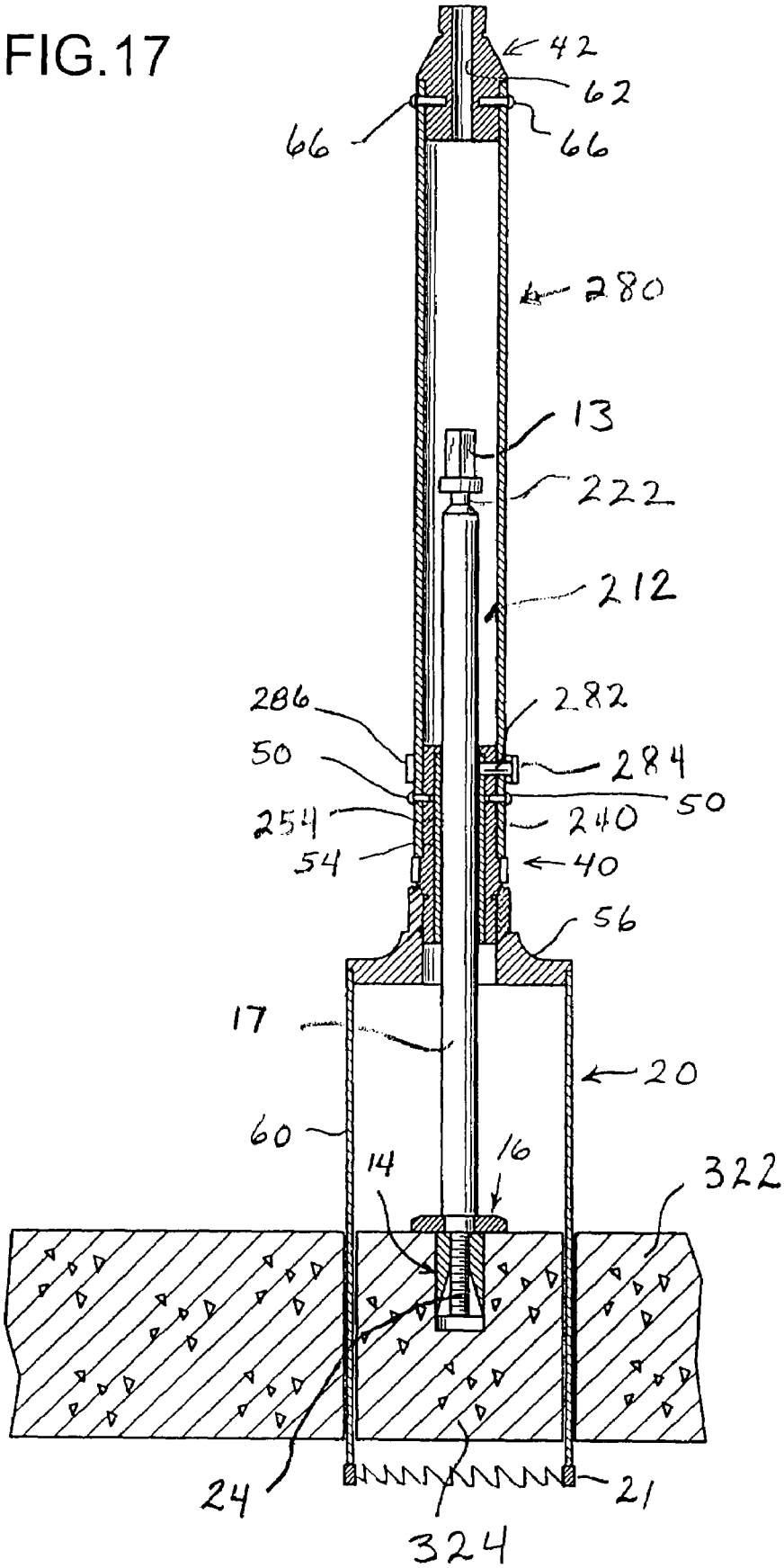
FIG. 17 is a sectional elevational view illustrating an alternative embodiment of the invention employing different types of catch and latching mechanisms.
Figure 19:
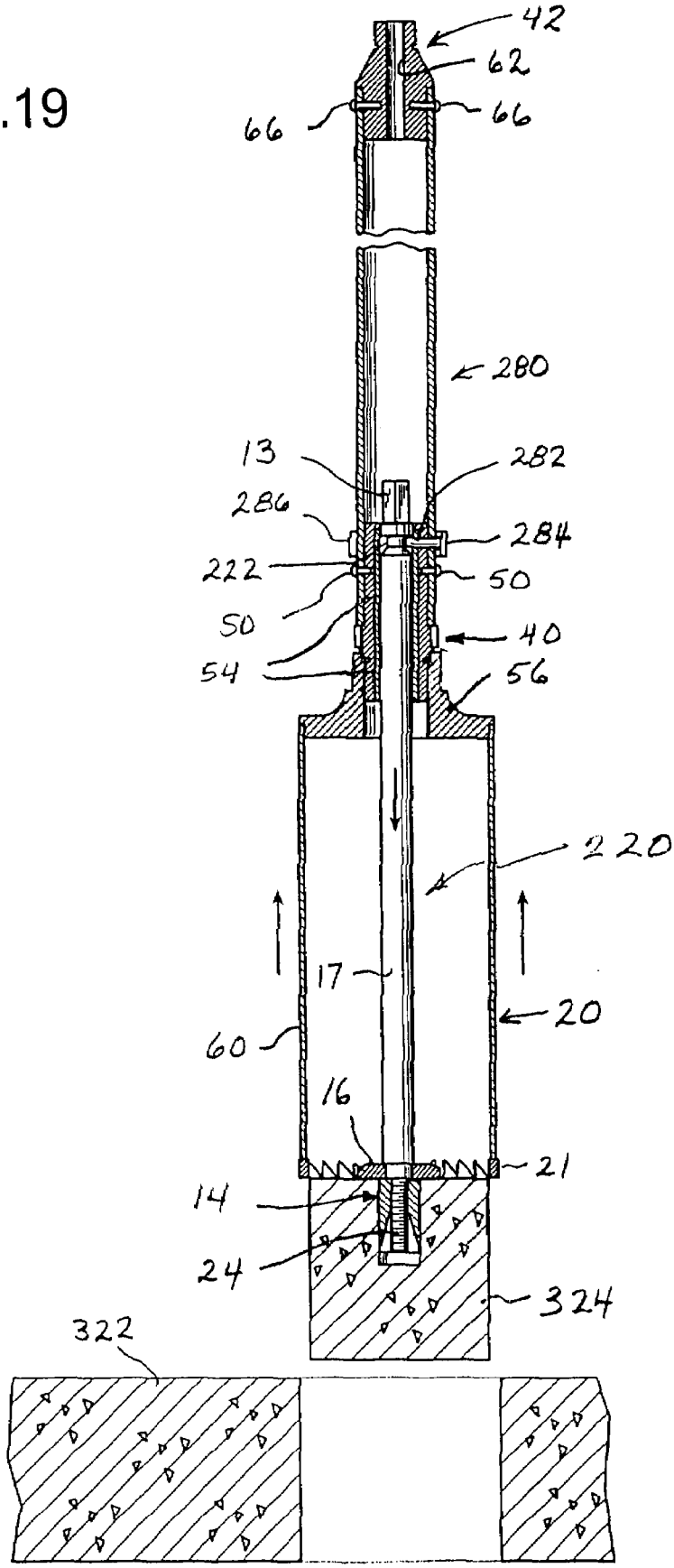
FIG. 19 is a sectional elevational view showing the catch and latching mechanisms of the embodiment of FIG. 17 engaged and illustrating removal of a concrete core from a concrete slab from which it has been extracted.
Figure 20:
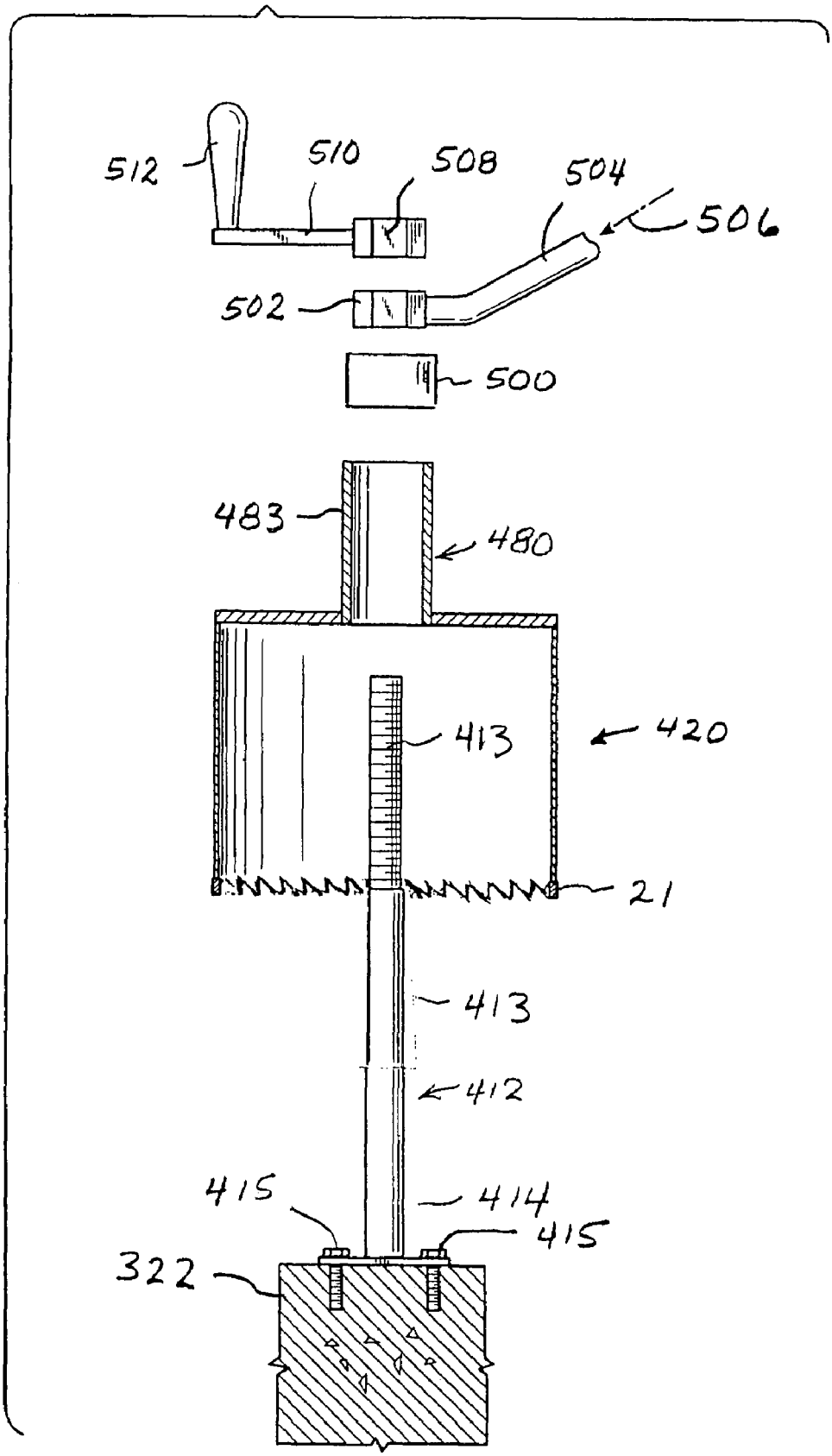
FIG. 20 is an exploded, sectional elevational view illustrating another alternative embodiment of the invention.

FIGS. 17, 18 and 19 illustrated a further, preferred embodiment of the invention in which the mandrel 212 is formed as a solid rod like the mandrel 12, but is provided with a releaseable latching mechanism in the form of a reduced diameter latching neck 222 located just below the hexagonal shaped upper mandrel end 13. The cylindrical, hollow annular drive shaft 280 is provided with a radially disposed catch pin 282. The drive shaft 280 has a radial catch pin receiving opening defined at its lower end through its cylindrical annular wall to receive the catch pin 282. Corresponding, aligned radial openings are also formed through the lower coupling 240 and the uppermost bearing 254 located radially within the confines of the lower coupling 240.

The catch pin 282 is secured to a generally horseshoe-shaped clip spring 284, illustrated in isolation in FIG. 18, and projects radially inwardly therefrom. The feet 286 of the spring clip 284 embrace the outer surface of the drive shaft 280 so that the arcuate portion 285 of the clip 284 is normally slightly elastically deformed when the inner tip of the catch pin 282 bears radially inwardly pressed into contact with the cylindrical outer surface 17 of the mandrel 212, as illustrated in FIG. 17. The spring clip 284 resiliently biases the catch pin 282 radially inwardly, urging it against the cylindrical outer surface 17 of the mandrel 212.

The catch pin 282 is radially movable within the catch receiving opening defined in the outer wall of the drive shaft 280 and the aligned apertures through the lower coupling 240 and the upper, cylindrical bearing 254. The hollow drive shaft 280 is normally longitudinally movable relative to the mandrel 212, as well as rotatable at high-speed rotation relative thereto. Therefore, as the large diameter core drill bit 20 drills an annular channel or groove into the concrete slab 322, the hollow drive shaft 280 moves longitudinally toward the lower, anchored end 24 of the mandrel 212.

Once the core drill bit 20 cuts completely through the thickness of the concrete slab 322 the mandrel 212 and the chunk of concrete 324 within the circumference of the core drill bit 20 will tend to drop vertically downwardly from the position show in FIG. 17, free from the concrete slab 322. However, the descent of the mandrel 212 and the "doughnut" 324 is halted when the latching neck 222 drops vertically to the level of the catch pin 282. This occurs when there is sufficient relative longitudinal movement between the hollow, cylindrical annular drive shaft 280 and the mandrel 212 to bring the catch pin 282 into longitudinal registration with the latching neck 222. That is, when the mandrel 212 drops downwardly far enough, the bias of the spring 284 pushes the catch pin 282 radially inwardly into engagement with the latching neck 222, thereby longitudinally immobilizing the mandrel 212 relative to the drive shaft 280.

The drive shaft 280 can then be lifted vertically, carrying the mandrel 212 and the concrete "doughnut" 324 with it, as illustrated in FIG. 19. By releaseably coupling the mandrel 212 to the drive shaft 280, damage or injury in the area beneath the concrete slab 322 is avoided. Once the drive shaft 280 and the mandrel 212 have been raised upwardly, as illustrated in FIG. 19, the mandrel 212 can be released by pressing laterally inwardly against the sides of the spring clip 24 which bows the arcuate portion 285 of the spring clip 284 radially outwardly, away from the mandrel 212. This action pulls the catch pin 282 radially out from engagement with the latching neck 222.

FIGS. 20-23 illustrate a further preferred embodiment of the invention especially suitable for use in drilling larger diameter bores in which the upwardly projecting engagement end 413 of the mandrel 412 is externally threaded. In this embodiment the anchoring end 414 of the mandrel 420 is bolted to the concrete slab 322 by concrete bolts 415.

In the embodiment of FIGS. 20-23 the lower, coupling end 481 of the hollow, tubular drive shaft 480 is permanently and rigidly secured to the tubular, annular core drill bit 420. The upper driving end 483 of the drive shaft 480 has a hexagonal, outer surface cross-sectional configuration. A cylindrical, annular Oil Lite sleeve bearing 54 is force fitted into the lower end 481 of the hollow drive shaft 480 and aids in maintaining the drive shaft 480 and core drill bit 420 in precise coaxial alignment relative to the mandrel 412.

A power transmission gearbox 430 is provided and is disposed about the upper driving end 483, of the hollow, annular drive shaft 480. The gearbox 480 contains a power input shaft 491 at its power input end which is journaled within the gearbox 480 for rotation and driven by a high-speed motor 492. The motor 492 may be a conventional motor of the type utilized to rotate a saw blade for sawing concrete and is provided with a saw blade guard 489. However, when utilized with the apparatus of the present invention, the saw blade is removed and instead the saw motor 492 receives the upwardly projecting end of the power input shaft 491 that protrudes from the top of the gearbox 430.

The gearbox 430 contains gears 493 and 494 and a chain drive system 495, 496. These power transmission elements reduce the speed and increase the torque of power delivered from the motor 492. The chain drive system 495,496 rotates a power output sleeve 497 that has an internal axial opening of hexagonal cross-sectional configuration. The sleeve 497 fits smoothly about the outer, hexagonal cross-sectional surface of the driving end 483 of the drive shaft 480 to drive it in rotation therewith.

The sleeve 497 rotates freely within bearings provided in the gearbox 430, but is entrapped by upper and lower retaining ledges 498 and 499 so that it is retained and longitudinally confined within the gearbox 430. Both the upper end 483 of the drive shaft 480 and the power output sleeve 497 are of a uniform cross-section throughout in an axial direction, so that free longitudinal movement of the sleeve 497 relative to the drive shaft 480 parallel to the axis of the mandrel 412 is possible.

Atop the drive shaft 480 there is a hollow, annular thrust bearing 500 at its upper extremity with an internal diameter slightly larger than the outer diameter of the threaded upper end 413 of the mandrel 412. A hollow, cooling water delivery collar 502 is located directly above the thrust bearing 500 and has a cooling water inlet line 504 connected thereto to receive cooling water as indicated by the directional arrow 506. The thrust bearing 500 permits relative rotation of the upper driving end 483 of the drive shaft 480 relative to the cooling water delivery collar 502. Immediately above the cooling water delivery collar 502 there is a drill bit advancement nut 508 that is threadably engaged with the threaded upper end 413 of the mandrel 412. A drill crank advancement arm 510 is secured by welding to the drill bit advancement nut 508 and projects radially therefrom. A vertically extending crank handle 512 projects perpendicularly upwardly from the radial outboard end of the crank arm 510.

The power transmission gearbox 430 is disposed about the hollow, cylindrical annular drill bit drive shaft 480 and is located longitudinally between the drill bit advancement nut 508 and the anchoring support end 414 of the mandrel 412. Prior to drilling, the base 414 of the mandrel 412 is first secured to the upper surface of the concrete slab 322 by means of the concrete bolts 415. The upper driving end 483 of the drive shaft 480 is then inserted through the hexagonal opening in the sleeve 497 that is entrapped within the gearbox 430. The drive shaft 480, with the core drill bit 420 rigidly secured thereto, is then lowered onto the mandrel 412 with the hollow, tubular upper driving end 483 of the drive shaft 480 disposed coaxially about the mandrel 412 and in spaced separation therefrom. The threaded upper end 413 of the mandrel 412 thereby projects up through the gearbox 430 and the drive shaft 480 and through the hollow thrust bearing 500.

The cooling water delivery collar 502 is then lowered onto the exposed tip of the upper end 413 of the mandrel 412 and the drill advancement nut 508 is then threaded onto the upper extremity of the upper end 413 of the mandrel 412 and advanced downwardly toward the mandrel base 414 until the teeth of the annular saw blade of the core drill bit 420 exert a light downward pressure against the upper, exposed surface of the concrete slab 322.

Figure 21:
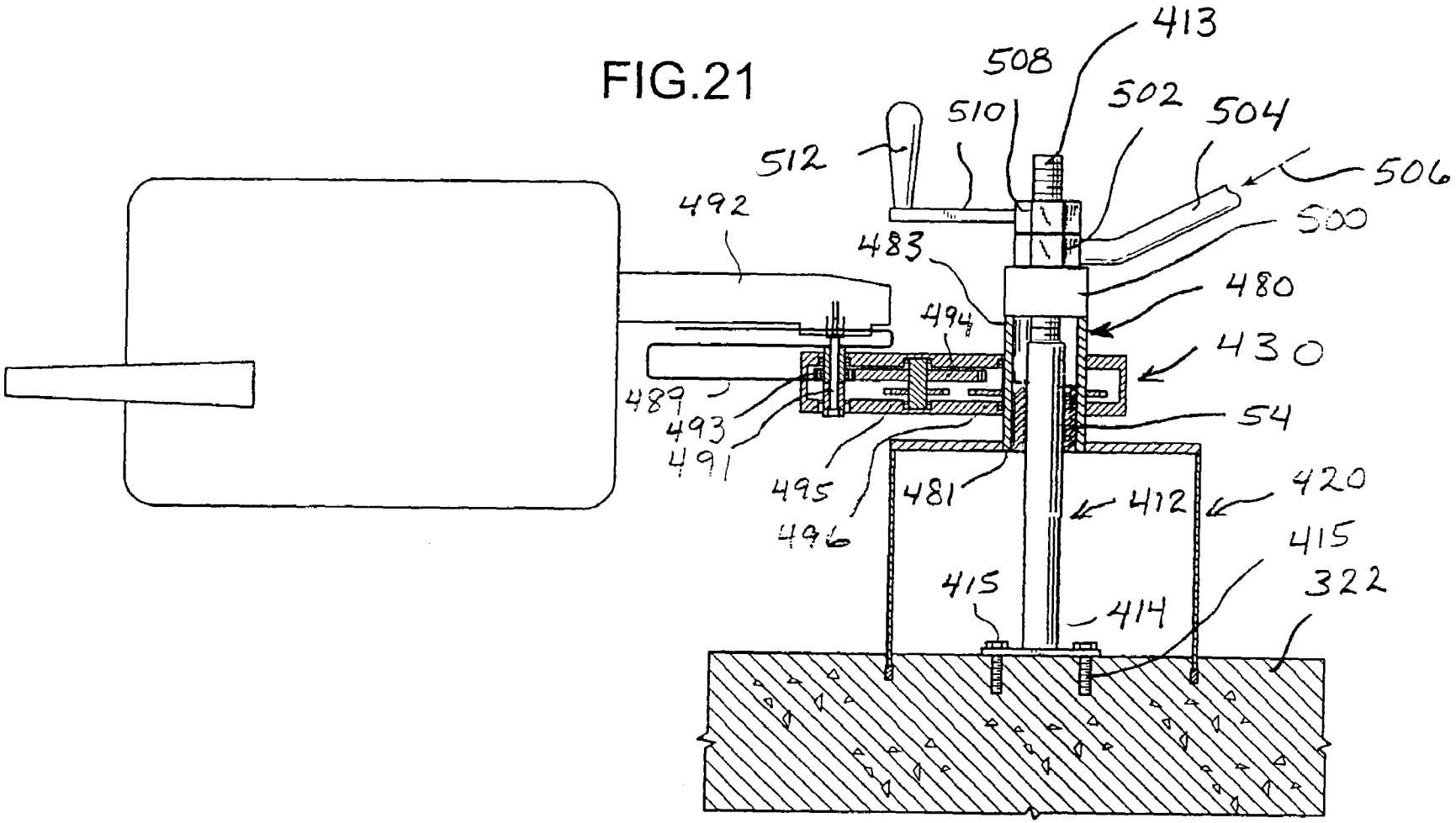
FIG. 21 is an elevational view, partially in section, showing the operation of the embodiment of FIG. 20 of the invention.
Figure 22:
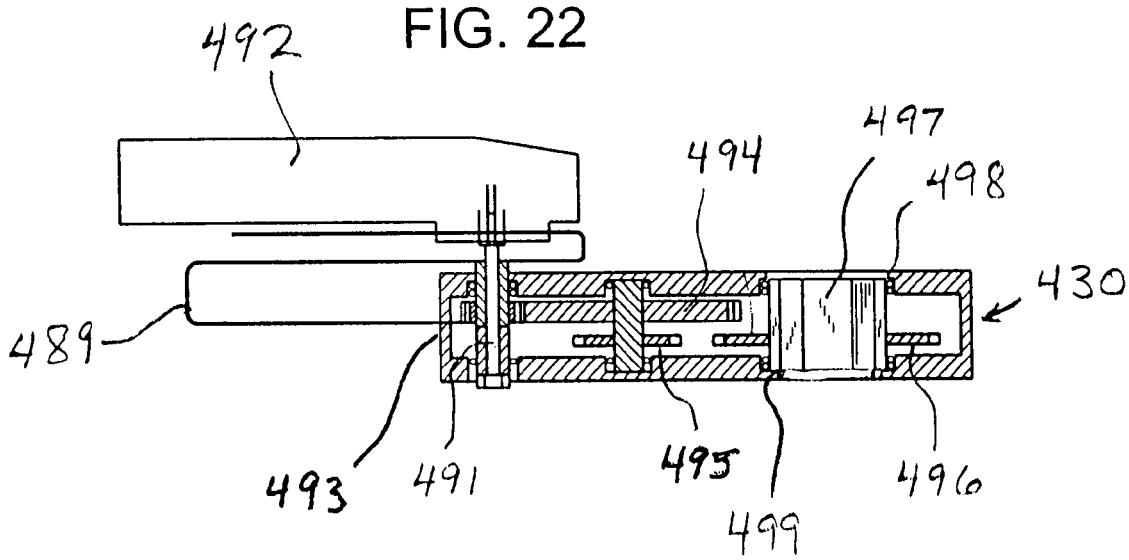
FIG. 22 is an enlarged elevational detail, partially in section, of a portion of the embodiment of FIG. 21.
Figure 23:
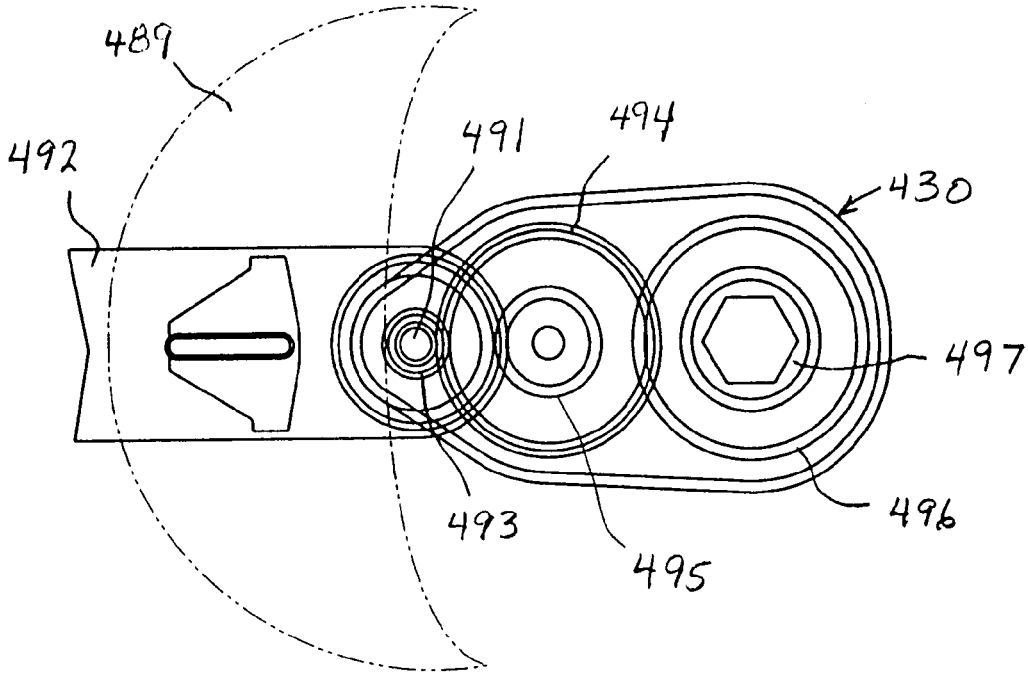
FIG. 23 is a top plan diagrammatic view showing the operating components illustrated in FIG. 22.

The power input shaft 491 is then inserted into the drive socket of the motor 492, so that all of the components of the embodiment of FIGS. 20-23 are engaged as illustrated in FIGS. 21-23. The motor 492 is then started, thereby causing the power input shaft 491 to rotate and to drive the sleeve 497 in rotation at reduced speed and increased torque. At the same time, cooling water is fed into the cooling water delivery collar 502 and flows down through the hollow drive shaft 480 alongside the mandrel 412. The flow of cooling water is forced downwardly due to the barrier created by the drill bit advancement nut 508. From there the water flows laterally upon the surface of the concrete slab 322, and down into the annular groove being drilled by the annular core drill bit 420. The cooling water flows through the annular channel formed by the cutting teeth of the core drill bit 420 and flushes the particulate concrete grit created outwardly across the upper surface of the concrete slab 322 and away from the mandrel 412.

As drilling progresses the operator rotates the crank handle 512 in an orbital path about the upright mandrel 412 to advance the drill advancement nut 508 slowly toward the base 414 of the mandrel 412. This downward force against the annular thrust bearing 500 at the top of the drive shaft 480 presses the teeth of the annular core drill bit 420 into the concrete slab 322, while simultaneously maintaining precise, coaxial alignment of the drive shaft 480 and the core drill bit 420 relative to the mandrel 412.

As the drilling proceeds, the operator slowly advances the handle 512 in rotation about the mandrel 412 to continually press the teeth of the core drill bit 420 downwardly into the annular channel created as the drill bit teeth bite into the concrete slab 322. As the drive shaft 480 is forced downwardly, the motor 492 and the gearbox 430 are moved down with it, although a certain amount of sliding, longitudinal movement is possible between the upper driving end 483 of the drive shaft 480 and the power output sleeve 497.

Rotation of the drive shaft 480 by the power input from the motor 422 continues in this fashion while maintaining continuous downward pressure upon the teeth of the drill bit 420 by continuous advancement of the core drill bit advancement nut 508. Drilling continues until the annular channel created by the rotating teeth of the drill bit 420 cuts completely through to the far side of the slab 322.

Undoubtedly, numerous other variations and modifications of the invention will become readily apparent to those familiar with hole coring systems for drilling holes in concrete and other materials that tend to crumble or otherwise deteriorate around the drive shaft during the drilling process. Accordingly, the scope of the invention should not be construed as limited to the specific embodiments depicted and described.

I claim:

1. An apparatus for drilling holes in a substrate with a drive motor comprising:

a mandrel having an upper end portion, a lower anchoring end portion attachable to the substrate, and a smooth cylindrical intermediate outer surface therebetween;

a hollow drive shaft disposed axially about the mandrel and engageable to the drive motor for rotating the drive shaft under power of the drive motor, the hollow drive shaft having a lower end portion;

at least one bearing mounted to the hollow drive shaft and seated on the smooth outer surface of the mandrel for permitting rotational and longitudinal movement between the mandrel and drive shaft, whereby said drive shaft is rotatable on the smooth outer surface of the mandrel and is independently movable longitudinally relative to the mandrel;

a hollow, tubular core drill bit attached to the lower end portion of said drive shaft which the drill bit has a lower cutting edge; and an expansion anchor mechanism located at the lower end of the mandrel for attaching the mandrel lower anchoring end portion to the substrate.

2. An apparatus according to claim 1 further comprising a stabilizing plate attached to the lower end portion of the mandrel and above said expansion anchor mechanism, the stabilizing plate positionable atop the substrate.

3. An apparatus according to claim 1 wherein said mandrel is formed of a rod sufficiently rigid to support the drill bit as it rotates about the mandrel and penetrates the substrate.

4. An apparatus according to claim 1 further comprising a lower drill bit coupling at the lower end of the hollow drive shaft.

5. An apparatus according to claim 4 wherein the core drill bit is formed as a separate structure from the hollow drive shaft and with an upper edge and the core drill bit has an internal diameter larger than an outer diameter of the hollow drive shaft, and further comprising a collar rigidly connecting the upper edge of the core drill bit to the lower drill bit coupling.

6. An apparatus according to claim 5 further comprising an upper drill bit coupling attached to the drive shaft.

7. An apparatus according to claim 1 wherein the mandrel is provided with a releasable latch and the hollow drive shaft is provided with an internal catch and whereby the latch engages the internal catch after the drive shaft is moved longitudinally relative to the mandrel and the latch and the catch are brought into longitudinal registration with each other.

8. An apparatus according to claim 1 wherein the drive shaft has an upper end portion with a drive motor coupling.

9. An apparatus according to claim 1 wherein an outer cross sectional configuration of the drive shaft has a hexagonal configuration.

10. An apparatus for drilling holes in a substrate with a drive motor comprising:

a mandrel having an upper end portion, a lower anchoring end portion attachable to the substrate, and a smooth clindrical intermediate outer surface therebetween;

a hollow drive shaft disposed axially about the mandrel and engageable to the drive motor for rotating the drive shaft under power of a drive motor, the drive shaft having a lower end portion;

at least one bearing mounted to the hollow drive shaft and seated on the smooth outer surface of the mandrel for permitting rotational and longitudinal movement between the mandrel and drive shaft, whereby said drive shaft is rotatable on the smooth outer surface of the mandrel and is independently movable longitudinally relative to the mandrel;

a hollow, tubular core drill bit attached to the lower end portion of said drive shaft which the drill bit has a lower cutting edge; and a lower drill bit coupling attached to a lower end portion of the drive shaft, the lower drill bit coupling formed with a tapering region;

a collar attached to the drill bit and the collar has a mating tapering region with the tapering region of the lower drill bit coupling;

whereby when the lower drill bit coupling is tightened in threaded engagement with the collar, the tapering region of the lower drill bit coupling resides in direct contact with and bears firmly against the mating tapering region of the collar.

11. An apparatus for drilling holes in a substrate with a drive motor comprising:

a mandrel having an upper end portion, a lower anchoring end portion attachable to the substrate, and a smooth cylindrical intermediate outer surface therebetween;

a hollow drive shaft disposed axially about the mandrel and engageable to the drive motor for rotating the drive shaft under power of the drive motor, the drive shaft having a lower end portion;

at least one bearing mounted to the hollow drive shaft and seated on the smooth outer surface of the mandrel for permitting rotational and longitudinal movement between the mandrel and drive shaft, whereby said drive shaft is rotatable on the smooth outer surface of the mandrel and is independently movable longitudinally relative to the mandrel;

a hollow, tubular core drill bit attached to the lower end portion of said drive shaft which the drill bit has a lower cutting edge; and a fluid swivel disposed adjacent the drive shaft, the fluid swivel having a fluid pathway in fluid communication with the hollow portion of the drive shaft and a fluid input port through the structure of the fluid swivel for providing lubrication and cooling during operation of the apparatus.

12. An apparatus according to claim 11 wherein the fluid input port is capable of receiving water.

13. An apparatus according to claim 11 wherein the fluid swivel is a liquid swivel.

14. A method of drilling into a concrete structure employing a mandrel having upper and lower end portions with a smooth, cylindrical outer surface therebetween, a hollow drive shaft disposed axially about the mandrel and having an upper end portion and an opposite lower end portion, at least one annular bearing disposed in the drive shaft and seated in rotational and longitudinal sliding contact with the smooth, cylindrical, intermediate, outer surface of the mandrel, and a hollow, tubular core drill bit having a lower cutting edge, the steps comprising:

attaching the mandrel to the concrete structure;

rotating the drive shaft about the mandrel at a cutting speed; and moving the drive shaft toward the structure, whereby said core drill bit drills a cylindrical annular groove in the concrete structure centered about the mandrel.

15. A method according to claim 14 further comprising forcing lubrication down the core drill bit and down into and out of the annular groove.

16. A method of drilling into a structure employing a mandrel having upper and lower end portions with a smooth, cylindrical outer surface therebetween, a hollow drive shaft disposed axially about the mandrel and having an upper end portion and an opposite lower end portion, at least one annular bearing disposed in the drive shaft and seated in rotational and longitudinal sliding contact with the smooth, cylindrical, intermediate, outer surface of the mandrel, and a hollow, tubular core drill bit having a lower cutting edge, the steps comprising:

attaching the mandrel to the structure;

rotating the drive shaft about the mandrel at a cutting speed; and moving the drive shaft toward the structure, whereby said core drill bit drills a cylindrical annular groove in the structure centered about the mandrel; and concurrently cooling the cutting edge of the core drill bit while rotating the drive shaft and cutting the structure.

17. A method of drilling into a structure employing a mandrel having upper and lower end portions with a smooth, cylindrical outer surface therebetween, a hollow drive shaft disposed axially about the mandrel and having an upper end portion and an opposite lower end portion, at least one annular bearing disposed in the drive shaft and seated in rotational and longitudinal sliding contact with the smooth, cylindrical, intermediate, outer surface of the mandrel, and a hollow, tubular core drill bit having a lower cutting edge, the steps comprising:

attaching the mandrel to the structure;

rotating the drive shaft about the mandrel at a cutting speed; and moving the drive shaft toward the structure, whereby said core drill bit drills a cylindrical annular groove in the structure centered about the mandrel; and flushing out the cylindrical annular groove with liquid while rotating the drive shaft and cutting the structure.

18. An apparatus for drilling holes in concrete with a drive motor comprising:

a central, cylindrical mandrel having an anchoring support end portion, an opposite proximal end portion, and a smooth, cylindrical, intermediate, outer surface therebetween, a hollow, cylindrical annular drive shaft disposed coaxially about the mandrel and engageable to the drive motor, the drive shaft having a driver end portion;

at least one bearing mounted to the annular, hollow drive shaft and residing in rotational and longitudinal sliding surface contact with the mandrel, whereby the drive shaft is freely rotatable about the mandrel and is movable longitudinally relative to the mandrel independent from the rotation of the drive shaft about the mandrel, and a hollow, tubular core drill bit at the driven end portion of the drive shaft, the drill bit having an annular cutting edge.

19. An apparatus according to claim 18 wherein the mandrel is provided with a latching mechanism and the hollow drive shaft is provided with an internal catch whereby the latching mechanism engages the internal catch once the drive shaft is moved longitudinally relative to the anchoring support end portion of the mandrel and arrives at a predetermined engagement position relative thereto.

20. An apparatus according to claim 19 wherein the mandrel is hollow and defines a mandrel cavity of circular cross section therewithin, an internal bearing ledge located above the anchoring support end portion of the mandrel and dividing the mandrel cavity into an upper cylindrical cavity portion and a lower cylindrical cavity portion, wherein the upper cylindrical cavity portion is greater in diameter than the lower cylindrical cavity portion, and a longitudinally elongated slot is defined in the mandrel extending radially between the smooth, cylindrical, intermediate, outer surface thereof and the lower cylindrical cavity portion therewithin and located beneath the bearing ledge, and diametrically opposed, radial latching lug openings are defined in the mandrel extending between the smooth, cylindrical, intermediate, outer surface thereof and the upper cylindrical cavity portion therewithin:

a piston having a circular cross-section and a shoulder dividing the piston into an enlarged diameter upper portion and a reduced diameter lower portion and the piston is mounted for reciprocal movement within the mandrel cavity;

a latch release lever projecting radially from the reduced diameter lower portion of the piston through the longitudinally elongated radial slot in the mandrel;

a piston head located at the upper portion of the piston and defining a latching lug receiving neck;

a pair of diametrically opposed latching lugs located in the mandrel at the diametrically opposed radial openings therein, and the latching lugs are radially shiftable to normal deployed positions projecting radially outwardly from the smooth, cylindrical, intermediate, outer surface of the mandrel and retracted positions projecting into the receiving neck of the piston head when in radial alignment therewith; and a spring biasing the piston head and the piston toward the anchoring support end portion of the mandrel and the latching lug receiving neck out of radial alignment with the latching lugs, whereby force on the latch release lever toward the upper end portion of the mandrel to overpower the spring moves the latching lug receiving neck of the piston head into radial alignment with the latching lugs thereby allowing the latching lugs to seat in the latching lug receiving neck, and the catch is formed as an internal, radial, annular ledge in the interior of the hollow drive shaft between the driving end portion thereof and the at least one bearing.

21. An apparatus according to claim 18 wherein the bearing is a sleeve bearing.

22. An apparatus according to claim 18 further comprising:

a power transmission box having a housing and an input, the power transmission box being interconnectable to the drive shaft;

a motor having a housing and an output shaft, the motor's housing being fixedly attached to the housing of the power transmission box, the motor's output shaft being connected to the input of the power transmission box.

23. An apparatus for drilling holes in concrete with a drive motor comprising:

a central, cylindrical mandrel having an anchoring support end portion, an opposite proximal end portion, and a smooth, cylindrical, intermediate, outer surface therebetween, a latching neck formed on a proximal end portion of the mandrel;

a hollow, cylindrical annular drive shaft disposed coaxially about the mandrel and engageable to the drive motor, the drive shaft having a catch receiving opening and a driver end portion;

at least one bearing mounted to hollow drive shaft and residing in rotational and longitudinal sliding surface contact with the mandrel, whereby the drive shaft is freely rotatable about the mandrel and is movable longitudinally relative to the mandrel independent from the rotation of the drive shaft about the mandrel;

a hollow, tubular core drill bit at the driven end portion of the drive shaft, the drill bit having an annular edge; and a catch pin movable within the catch receiving opening of the drive shaft, the catch pin being biased toward the mandrel;

whereby the catch pin engages the latching neck when relative longitudinal movement between the drive shaft and the mandrel brings the catch pin into longitudinal registration with the latching neck.

24. An apparatus for drilling holes in concrete with a drive motor comprising:

a central, cylindrical mandrel having an anchoring support end portion, an opposite threaded proximal end portion, and a smooth, cylindrical, intermediate, outer surface therebetween, a hollow, cylindrical annular drive shaft disposed coaxially about the mandrel and engageable to the drive motor, the drive shaft having a drive portion;

at least one bearing mounted to the hollow drive shaft and residing in rotational and longitudinal sliding surface contact with the mandrel, whereby the drive shaft is freely rotatable about the mandrel and is movable longitudinally relative to the mandrel independent from the rotation of the drive shaft about the mandrel;

a hollow, tubular core drill bit at the driven portion of the drive shaft, the drill bit having an annular edge; and a drill bit advancement nut radially engaged with the threaded proximal end portion of the mandrel and a drill crank advancement arm is secured to and projecting radially from the drill bit advancement nut, and further comprising a power transmission box disposed about the hollow, cylindrical annular drive shaft and located longitudinally between the drill bit advancement nut and the anchoring support end portion of the mandrel, and the power transmission box is provided with a rotatable, power delivery input, speed reduction power transfer elements driven by the power deliver input, and a power output sleeve driven by the power transmission elements wherein the power output sleeve is longitudinally confined within the power transmission box and is freely rotatable therewithin, and the power output sleeve engages the driving end of the hollow drive shaft to drive it in rotation therewith.

25. An apparatus for drilling holes in concrete with a drive motor comprising:

a central, cylindrical mandrel having an anchoring support end portion, an opposite threaded proximal portion, and a smooth, cylindrical, outer surface therebetween, a hollow, cylindrical annular drive shaft disposed coaxially about the mandrel and engageable to the drive motor, the drive shaft having a driven portion and a driving portion, at least one bearing mounted to the hollow drive shaft and residing in rotational and longitudinal sliding surface contact with the mandrel, whereby the drive shaft is freely rotatable about the mandrel and is movable longitudinally relative to the mandrel independent from the rotation of the drive shaft about the mandrel;

a hollow, tubular core drill bit at the driven portion of the drive shaft, the drill bit having an annular edge; and a drill bit advancement nut radially engaged with the threaded proximal end portion of the mandrel.

26. An apparatus according to claim 25 further comprising a drill crank advancement arm secured to and projecting radially from the drill bit advancement nut.

27. An apparatus according to claim 25 further comprising a power transmission box disposed about the hollow, cylindrical annular drive shaft and located longitudinally between the drill bit advancement nut and the anchoring support end portion of the mandrel, and the power transmission box is provided with power transfer elements driven by the drive motor, and a power output sleeve driven by the power transmission elements wherein the power output sleeve engages the driving portion of the hollow drive shaft to drive it in rotation therewith.

* * * * *